US006055922A

United States Patent [19]

Madachi et al.

[11] Patent Number: 6,055,922

[45] Date of Patent: May 2, 2000

[54] STEERING CONTROL FOR WATERCRAFT

[75] Inventors: Takaaki Madachi; Tatsuya Yoshida; Masahiro Harada, all of Hamamatsu, Japan

[73] Assignee: Yamaha Hatsudoki Kabushiki Kaisha, Iwata, Japan

[21] Appl. No.: 08/988,244

[22] Filed: Dec. 1, 1997

[30] Foreign Application Priority Data

| | | | |
|---|---|---|---|
| Nov. 29, 1996 | [JP] | Japan | 8-359798 |
| Dec. 27, 1996 | [JP] | Japan | 8-358054 |
| May 13, 1997 | [JP] | Japan | 9-139262 |

[51] Int. Cl.[7] ..... B63H 25/10

[52] U.S. Cl. ..... 114/144 R

[58] Field of Search ..... 114/114 R, 55.52

[56] References Cited

U.S. PATENT DOCUMENTS

| | | | |
|---|---|---|---|
| 4,726,311 | 2/1988 | Niina | 114/55.52 |
| 4,896,559 | 1/1990 | Marier et al. | 74/551.4 |
| 4,989,532 | 2/1991 | Kishi et al. | 114/144 R |
| 5,101,751 | 4/1992 | Kobayashi | 114/144 R |
| 5,218,920 | 6/1993 | Kobayashi | 114/144 R |
| 5,282,437 | 2/1994 | De Basto | 114/55.52 |
| 5,361,717 | 11/1994 | Kobayashi | 114/361 |
| 5,372,082 | 12/1994 | Hattori | 114/144 R |
| 5,390,622 | 2/1995 | Kishi et al. | 114/357 |

*Primary Examiner*—Jesus D. Sotelo

*Attorney, Agent, or Firm*—Knobbe, Martens, Olson & Bear, LLP

[57] ABSTRACT

The invention provide an adjustable steering mechanism for a watercraft. The watercraft has a hull including a main body, an upper wall engaging the hull and cooperating therewith to define an engine compartment for housing an engine. The engine has an output shaft arranged to drive a water propulsion device of the watercraft. The upper wall has a top surface and a bottom surface. The bottom surface facing forwardly towards engine compartment. A first steering means extends through the upper wall and is in communication with a steering mechanism of the watercraft. The first steering means also coupled to a steering shaft and handle. The steering shaft and handle are journalled for rotation about a first axis with respect to a rotation member. The rotation member being rotatably affixed to the top side of the upper wall opposite the engine compartment thereby allowing the rotation of the rotation member and the steering shaft and handle in a forward and rearward direction about a second axis generally perpendicular to a longitudinal axis of the watercraft and the first axis and whereby the steering shaft and handle is independently rotatable with respect to the rotation member about the first axis.

64 Claims, 22 Drawing Sheets

STEERING CONTROL FOR WATERCRAFT

BACKGROUND OF THE INVENTION

1. Field of the Invention

The present invention relates in general to a personal watercraft, and in particular to an adjustable steering mechanism for the personal watercraft.

2. Description of Related Art

Personal watercraft have become popular in recent years. This type of watercraft is sporting in nature; it turns swiftly, is easily maneuverable, and accelerates quickly. Personal watercraft today commonly carry one rider and one or two passengers.

A relatively light weight, small hull of the personal watercraft defines an engine compartment below a rider's area. An internal combustion engine frequently lies within the engine compartment in front of a tunnel formed on the underside of the watercraft hull. The internal combustion engine commonly powers a jet propulsion device located within the tunnel. An impeller shaft commonly extends between the engine and the propulsion device for this purpose. Such small watercraft today are capable of traveling at high rates of speed.

Personal watercraft almost always include a steering mechanism to steer and guide the watercraft. The steering mechanism often includes a handle bar and a protective pad or cushion for the protection of the operator. Also, it is also common to locate the controls for the watercraft on the handle bar. For instance, several personal watercraft include a throttle mechanism as well as a start and kill switch on the handle bar assembly.

In order to accommodate operators of different sizes, adjustable steering mechanisms have been provided for personal watercraft. There have, however, been several design problems with the prior art. First, an adjustable steering mechanism typically occupies more space that a fixed steering mechanism resulting in a larger structure needed to house the mechanism. The enlargement of the housing typically increases the overall wind resistance of the watercraft and subsequently degrades the overall performance. Therefore, an adjustable steering mechanism that does not require an enlarged structure is desired.

A further problem with an adjustable steering mechanism stems from the fact that the steering mechanism is typically attached to a steering controller device in the engine compartment of the watercraft. A problem arises when the steering mechanism is moving or rotating with respect to the engine compartment thereby creating a large area in which water can enter. By allowing water to enter the engine compartment, the durability of the engine components can be decreased. Therefore, a steering mechanism in which water is prevented from entering the engine compartment is desired.

Yet another problem typically associated with an adjustable steering mechanism is the visibility of the display. Display visibility problems exist when the display is fixed on the watercraft and is blocked by any part of the steering mechanism. Likewise, the visibility of displays that move with the steering mechanism can also have problems if the movement of the mechanism locates the display in a position that cannot be seen by the operator. Therefore, an adjustable steering mechanism that allows for visibility of the display in all positions is desired.

A further problem associated with an adjustable steering column is operator comfort. This problem occurs when the movement of the steering mechanism locates the associated controls in ergonomically uncomfortable positions. Another aspect of ergonomic comfort is the location of the control for adjusting the steering mechanism. The locking and operating controls, therefore, must be located in areas that are readily accessible to the operator. Thus, an adjustable steering that provides operator comfort is desired.

SUMMARY OF THE INVENTION

A need therefore exists for an adjustable steering mechanism for a personal watercraft.

This invention is for a watercraft having a hull including a main body. The hull further includes an upper wall engaging the hull and cooperating therewith to define an engine compartment for housing an engine. The engine has an output shaft arranged to drive a water propulsion device of the watercraft. The upper wall has a top surface and a bottom surface. The bottom surface faces forwardly towards the engine compartment. A first steering means extends through the upper wall and is in communication with a steering mechanism of the watercraft. The first steering means is also coupled to a steering shaft and handle, and the steering shaft and handle are journalled for rotation about a first axis with respect to a rotation member. The rotation member is rotatably affixed to the top side of the upper wall and positioned on a side of the upper wall opposite the engine compartment thereby allowing the rotation of the rotation member and the steering shaft and handle in a forward and rearward direction about a second axis that is generally perpendicular to a longitudinal axis of the watercraft and the first axis additionally the steering shaft and handle are independently rotatable with respect to the rotation member about the first axis.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the adjustable steering mechanism of the present watercraft. The illustrated embodiment is intended to illustrate, but not to limit the invention. The drawings contain the following figures.

DETAILED DESCRIPTION OF THE PREFERRED EMBODIMENTS OF THE INVENTION

Figure 1:
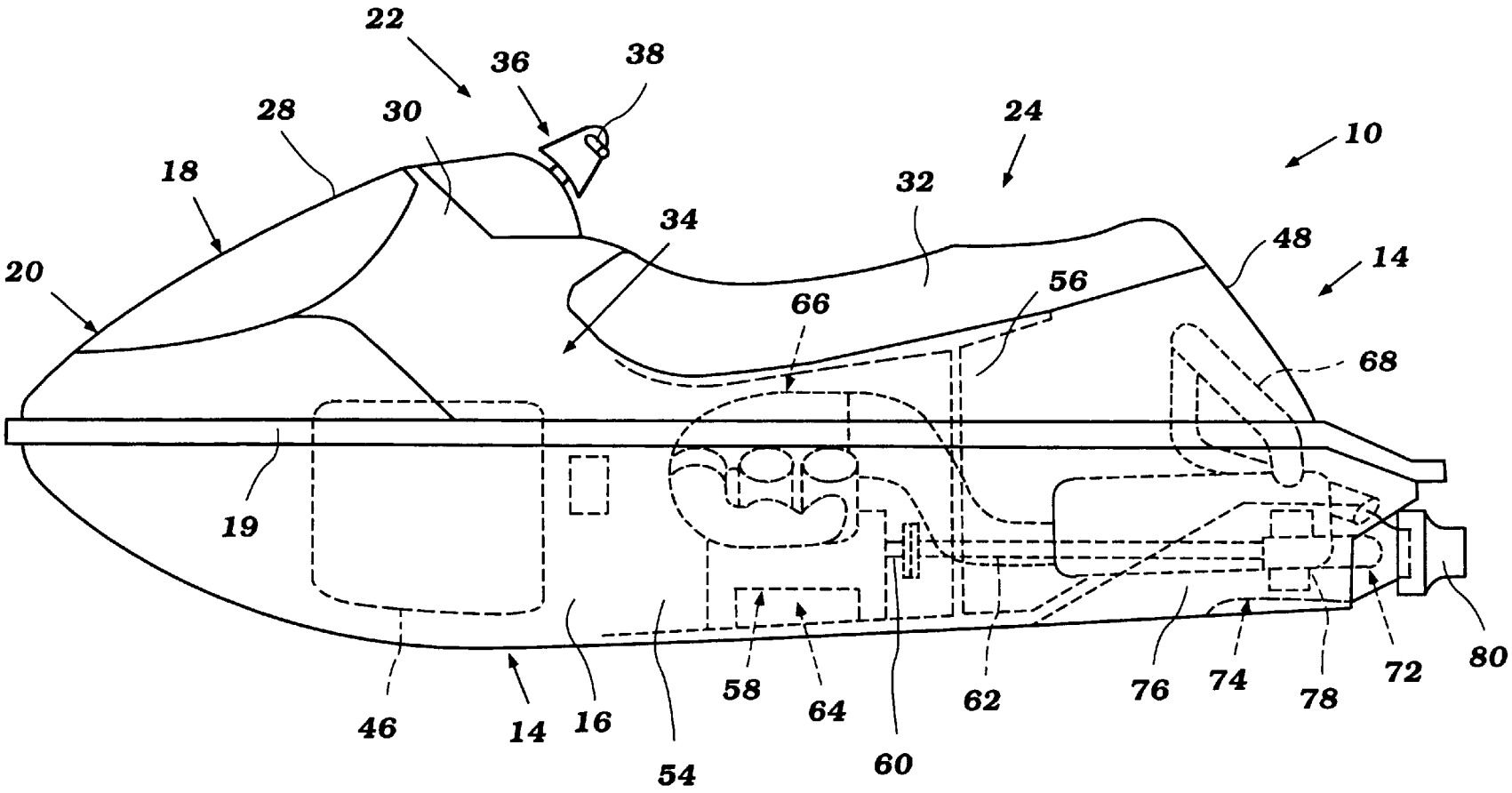
FIG. 1 is a side elevational view of a personal watercraft configured in accordance with a preferred embodiment of the present invention, and illustrates several internal components of the watercraft in phantom.
Figure 2:
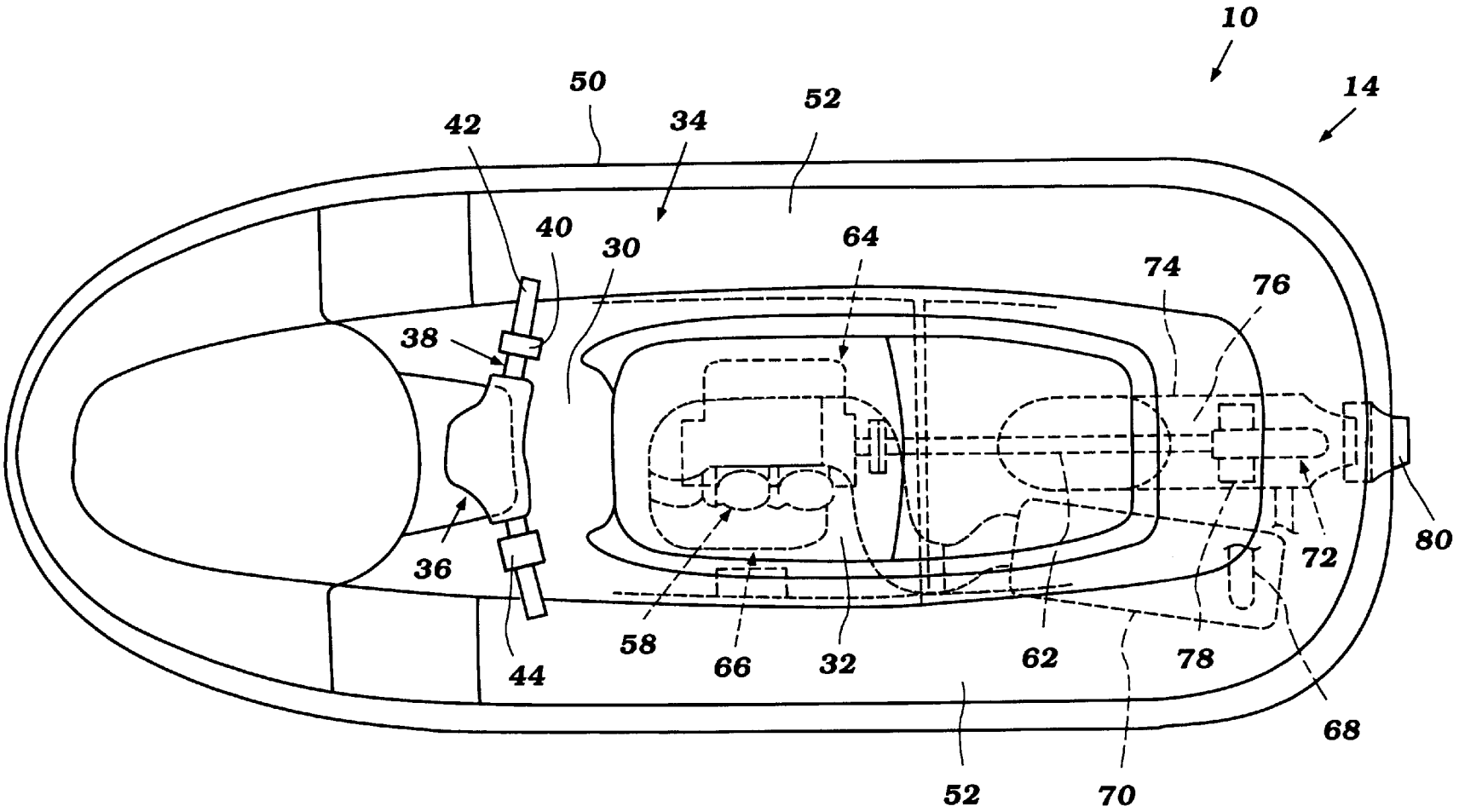
FIG. 2 is a top plan view of the personal watercraft of FIG. 1 with several internal components of the watercraft illustrated in phantom.

FIGS. 1 and 2 illustrate a watercraft incorporating an adjustable steering mechanism configured in accordance with a preferred embodiment of the present invention. The adjustable steering mechanism has particular utility with a personal watercraft, and therefore is illustrated in connection with such a vehicle. It is contemplated, however, that the adjustable steering mechanism can be used with other types of vehicles as well, such as, for example, but without limitation, small jet boats and the like.

With initial reference to FIGS. 1 and 2, the watercraft 10 includes a hull 14 formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the peripheral edges 19 in any suitable manner.

As viewed in the direction from the bow to the stem of the watercraft, the upper deck section 18 includes a bow portion 20, a control mast 22 and a rider's area 24. The bow portion 20 slopes upwardly toward the control mast 22 and includes at least one air duct (not shown) through which air can enter the hull 14.

An upper wall portion 30 engages the hull and defines the engine chamber. As best seen in FIG. 1 the lid 28 is shaped to include the same overall contour lines of the upper hull 18. In a preferred embodiment the seat 32 is formed to mate with the upper panel 30 and form a water tight seal for the engine compartment. The upper wall 30 also contacts the deck portion 34 forming a pedestal on which the seat 32 is located.

As best illustrated in FIGS. 1 and 2, a steering handle assembly 38 extends from the steering mast 22. The steering handle 38 is connected to a steering mechanism (described in more detail below) for use in directing the watercraft 10. As is known to those skilled in the art, the steering handle 38 is generally T-shaped, having a cross-bar with opposing handle portions. Preferably, a grip 42 for gripping by the hand of the watercraft operator is mounted at the end of each opposing handle portion.

Numerous watercraft controls are positioned adjacent at least one of the grips 42 for use by the operator in controlling the watercraft 10. In the embodiment illustrated, a throttle control 40 preferably extends along the outside of the grip 42. Likewise, a switch box 44 is connected to the handle portion of the steering handle 38 adjacent the grip 42. The box 44 can include a kill switch for use by the user in killing the engine of the watercraft. In addition, a starter switch can be provided for activating the starter and starting the engine. A lanyard switch (not shown) can also be provided for killing the engine in the event the operator falls from the watercraft or otherwise loses control and can not reach the kill switch. As is well known, the lanyard switch preferably includes a pin connected to the switch and a clip connected to the pin. A cord has one end connected to the clip and another which has a loop or similar attachment for connection to the operator of the watercraft. In the event the operator falls from the watercraft 10, the cord is stretched, tripping the switch and killing the engine.

As seen in FIG. 1, a fuel tank 46 is located within the hull 14 beneath the lid 28. Conventional means, such as, for example, straps, secure the fuel tank 46 to the lower hull 16. A fuel filler hose extends between a fuel cap assembly and the fuel tank. In the illustrated embodiment, the filler cap assembly (not shown) is secured to the bow portion 20 of the hull upper deck 18 to the side and in front of the control mast 22. In this manner, the fuel tank can be filled from outside the hull 14 with the fuel passing through the fuel filler hose into the tank 46.

With reference to FIGS. 1 and 2, the rider's area 24 lies behind the control mast 22 and includes a seat assembly 32. In the illustrated embodiment, the seat assembly 32 has a longitudinally extending straddle-type shape that may be straddled by an operator and by at least one or two passengers. The seat assembly 32 is formed by a seat cushion supported by a raised pedestal 48. The raised pedestal 48 has an elongated shape and extends longitudinally along the center of the watercraft 10. The seat cushion 32 desirably is removably attached to a top surface of the pedestal 48 and covers the entire upper end of the pedestal 48 for rider and passenger comfort.

The upper deck section 18 of the hull 14 advantageously includes a pair of raised gunnels 50 (FIG. 2) positioned on opposite sides of the aft end of the upper deck assembly 34. The raised gunnels 50 define a pair of foot areas 52 that extend generally longitudinally and parallel to the sides of the pedestal 48. In this position, the operator and any passengers sitting on the seat assembly 32 can place their feet in the foot areas 52 with the raised gunnels 50 shielding the feet and lower legs of the riders. A non-slip (e.g., rubber) mat desirably covers the foot areas 52 to provide increased grip and traction for the operator and the passengers.

With reference to FIG. 1, the lower hull 16 is designed such that the watercraft 10 planes or rides on a minimum surface area at the aft end of the lower hull 16 in order to optimize the speed and handling of the watercraft 10 when up on plane. For this purpose, the lower hull section generally has a V-shaped configuration formed by a pair of inclined sections that extend outwardly from a keel line of the hull to the hull's side walls at a dead rise angle. The inclined sections also extend longitudinally from the bow toward the transom of the lower hull 14. The side walls are generally flat and straight near the stern of the lower hull and smoothly blend towards the longitudinal center of the watercraft at the bow. The lines of intersection between the inclined section and the corresponding side wall form the outer chines of the lower hull section.

The lower hull portion 16 principally defines the engine compartment 54 in front of a bulkhead 56 (FIG. 1). Except for the air ducts (not shown) the engine compartment 54 is preferably substantially sealed so as to enclose an engine 58 of the watercraft 10 from the body of water in which the watercraft 10 is operated.

The internal combustion engine 58 powers the watercraft 10. The engine 58 is positioned within the engine compartment 54 and is mounted centrally within the hull 14. Vibration-absorbing engine mounts secure the engine 58 to the lower hull portion 16 in a known manner.

In the illustrated embodiment, the engine 58 includes a plurality of in-line cylinders and operates on a two-stroke, crankcase compression principle. The engine 58 is positioned such that the row of cylinders lies parallel to a longitudinal axis of the watercraft 10, running from bow to stem. This engine type, however, is merely exemplary. Those skilled in the art will readily appreciate that the present fuel delivery system can be used with any of a variety of engine types having other numbers of cylinders, having other cylinder arrangements and operating on other combustion principles (e.g., the four-stroke principle or the rotary principle).

A cylinder block and a cylinder head assembly desirably form the cylinders of the engine. A piston reciprocates within each cylinder of the engine and together the pistons drive an output shaft 60, such as a crankshaft, in a known manner. A connecting rod links the corresponding piston to the crankshaft 60. The corresponding cylinder bore, piston and cylinder head of each cylinder forms a variable-volume chamber, which at a minimum volume defines a combustion chamber.

The crankshaft 60 desirably is journalled with a crankcase, which in the illustrated embodiment is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber. Each crankcase chamber also communicates with a charge former of an induction system through a check valve (e.g., a reed-type valve). The induction system receives fuel from a fuel tank 46, which is positioned within the hull 16, and produces the fuel charge which is delivered to the cylinders in a known manner.

An oil tank (not shown) is also located forward of the engine. A suitable oil delivery system supplies oil from the tank to the engine 58 in a known manner.

Because the internal details of the engine 58, the fuel supply system and the induction system desirably are conventional, a further description of the engine construction is not believed necessary to understand and practice the invention.

As seen in FIG. 1 and FIG. 2, a coupling interconnects the engine crankshaft 60 to an impeller shaft 62 of the propulsion unit 64. A bearing assembly, which is secured to the bulkhead 56, supports the impeller shaft 62 behind the shaft coupling.

An exhaust system 66 is provided to discharge exhaust byproducts from the engine 58 to the atmosphere and/or to the body of water in which the watercraft 10 is operated. The exhaust system 66 includes an exhaust manifold that is affixed to the side of the cylinder block and which receives exhaust gases from the variable-volume chambers through exhaust ports in a well-known manner.

As best illustrated in FIG. 2, an exhaust pipe 68 extends from an outlet section of the water trap device 70 and wraps over the top of the aft tunnel section to a discharge pipe. As described in detail above, exhaust is routed from the engine 58 through the exhaust system to the exhaust pipe 68. This exhaust pipe 68 is connected to a body of the pipe 68 which is mounted at the stern of the watercraft 10. The body is adapted to route the exhaust from the exhaust pipe 68 to a point exterior to the watercraft 10 at the stem thereof.

The impeller shaft 62 drives a propulsion device 72 of the watercraft. In the illustrated embodiment, a jet pump unit 72 propels the watercraft 10. A portion of the jet pump unit 72 is mounted within the aft tunnel formed on the underside of the lower hull section 16 by a plurality of bolts. The intake duct 74 at its front lower end defines an inlet opening that opens into a gullet 76 of the intake.

The gullet 76 of the intake duct 74 leads to an impeller housing assembly (not shown) in which an impeller 78 of the jet pump 72 operates. An impeller housing assembly also acts as a pressurization chamber and delivers the water flow from the impeller housing to a discharge nozzle housing.

The impeller shaft 62 supports the impeller 78 within the impeller housing of the unit 72. The aft end of the impeller shaft 62 is suitably supported and journalled within the pressurization chamber of the assembly in a known manner. The impeller shaft 62 extends in the forward direction through the bulkhead 56 of the tunnel.

A steering nozzle 80 is supported at the downstream end of the discharge nozzle for effecting directional changes of the watercraft 10 as is well known. The nozzle 80 is rotatably mounted to the watercraft 10 about a generally vertical axis via at least one pin (not shown). In this manner, movement of the steering linkage (not shown) causes the nozzle 80 to move along a vertical axis and about the pin.

As described in more detail above, the watercraft 10 also includes a steering handle 38 for use by the operator in steering the watercraft 10. Though not illustrated in detail herein, the steering handle 38 is connected via a linkage to the nozzle 80 for effectuating movement of the nozzle from side-to-side in a horizontal plane.

With reference to FIG. 1, the propulsion unit 72 supplies cooling water through a conduit to an engine cooling jacket. For this purpose, an outlet port is formed on the housing of the pressurization chamber assembly of the jet pump 72. The conduit is coupled to the outlet port and extends to an inlet port to the engine water jacket. Preferably, the inlet port desirably lies at the lower rear end of the engine 58, either on the cylinder block or on an exhaust manifold of the engine which is attached to the cylinder block.

The engine cooling jacket extends through the exhaust manifold, through the cylinder block, about the cylinders, and through the cylinder head assembly. Either the cylinder head assembly or the exhaust manifold can include a coolant discharge port through which the cooling water exits the engine and thence flows through at least a portion of the exhaust system. Preferably, the discharge port is formed in the cylinder head assembly. A conduit connects the discharge port to the exhaust system. The cooling water thence flows through the water jacket of the exhaust system 68 in the manner described above.

Figure 3:
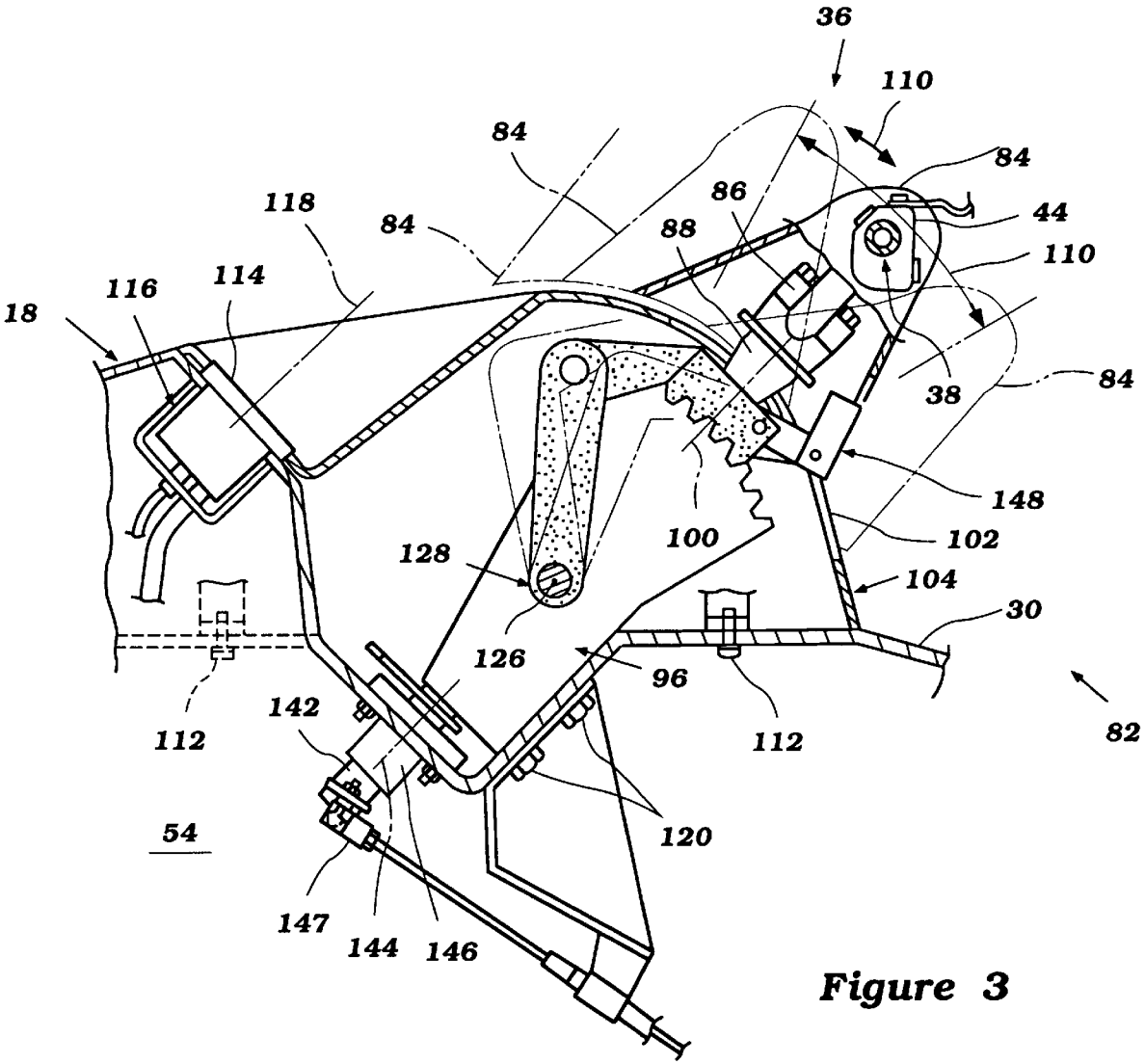
FIG. 3 is a side cross-sectional view of an adjustable steering mechanism of the watercraft of FIG. 1.

The description of the watercraft until this point is conventional. The adjustable steering mechanism will now be described in detail. Referring first to FIG. 3, the adjustable steering mechanism is referred to generally as 82. Starting from the top portion of the control mast 22, the adjustable steering mechanism 82 includes the steering assembly 36. The steering assembly 36 includes a T-shaped handle bar 38. As previously described and best shown in FIG. 7 engine controls such as the throttle 40 and the switch box 44 are positioned on the inside of the grips 42.

An elastomeric pad 84 is mounted on the handle bar 38 and substantially surrounds the handle bar 38. The pad 84 has a front edge and a rear edge. Further, the pad 84 includes a generally arcuate bottom side that will be described more fully below. Also, the pad 84 extends upward and terminates in a gentle arc toward the operator of the watercraft and is designed to provide a cushion between the operator and the handle bar 38 for riding comfort and for when the operator bumps the handle bar area 38. The pad 84 not only covers the handle bar 38 but also the clamp assembly 86 and at least a portion of the pad 84 is positioned above the cover which is more fully discussed below.

The clamp assembly 86 secures the handle bar 38 to the steering shaft 88. As illustrated in FIGS. 4–7 the clamp assembly 86 is comprised of two brackets 90 which at least partially surround the handle bar 38. The brackets 90 have through holes in alignment with a pair of threaded holes in a pair of mating brackets 92. The mating brackets 92 are also designed to partially surround the handle bar 38 and in conjunction with the brackets 90 to completely surround the handle bar 38. The brackets 92 are fastened to the brackets 90 by a plurality of bolts 94 as is well known in the art.

The steering shaft 88 is rotatably affixed to a rotation member 96 which will be more fully described below. The steering shaft 88 is mounted to the rotation member 96 by a plurality of bearings 98. The bearings 98 support the steering shaft 88 for rotation about an axis 100. During normal use the operator can rotate the handle bar 38 thereby rotating the steering shaft 88 which in turn controls the steering nozzle thereby turning the watercraft 10.

Figure 4:
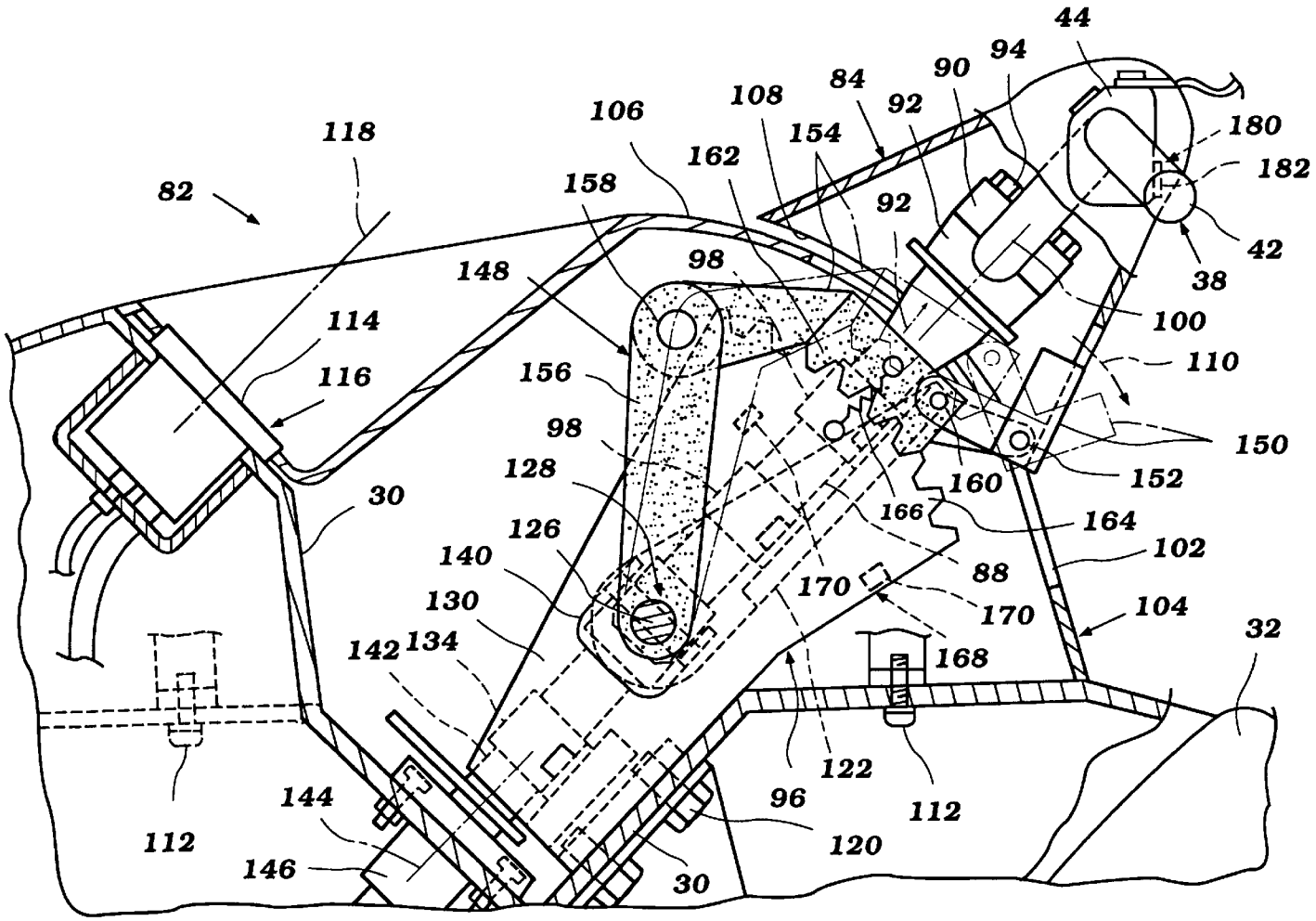
FIG. 4 is an enlarged side cross-sectional view of the adjustable steering mechanism of the watercraft of FIG. 1 in a middle position.

As best illustrated in FIG. 4, the steering shaft 88 extends through a longitudinally extending slot 102 in a cover member 104. The cover member 104 is typically formed of a molded resin or other suitable material. The slot 102 is sized to accommodate the steering shaft 88 in the full range of travel of the steering shaft 88 as will be described below. The upper surface 106 of the cover member 104 is arcuate, and preferably forms a convex arc.

The upper surface 106 preferably has a clearance fit with a concave lower surface 108 of the pad 84 so that the surfaces 106 and 108 will not contact each other through the full course of travel 110 of the adjustable steering mechanism 82. The cover member 104 is attached to a top side of upper wall 30 with mechanical fastening means such as a bolt 112.

On the top side of the cover 104 a recessed area is created to mount display 114. The recessed area is below the surface of the upper hull 18 and in the preferred embodiment the engine tachometer 116 is located therein. The line of sight for the tachometer 116 is defined as line 118 extending from the face of the tachometer.

Figure 6:
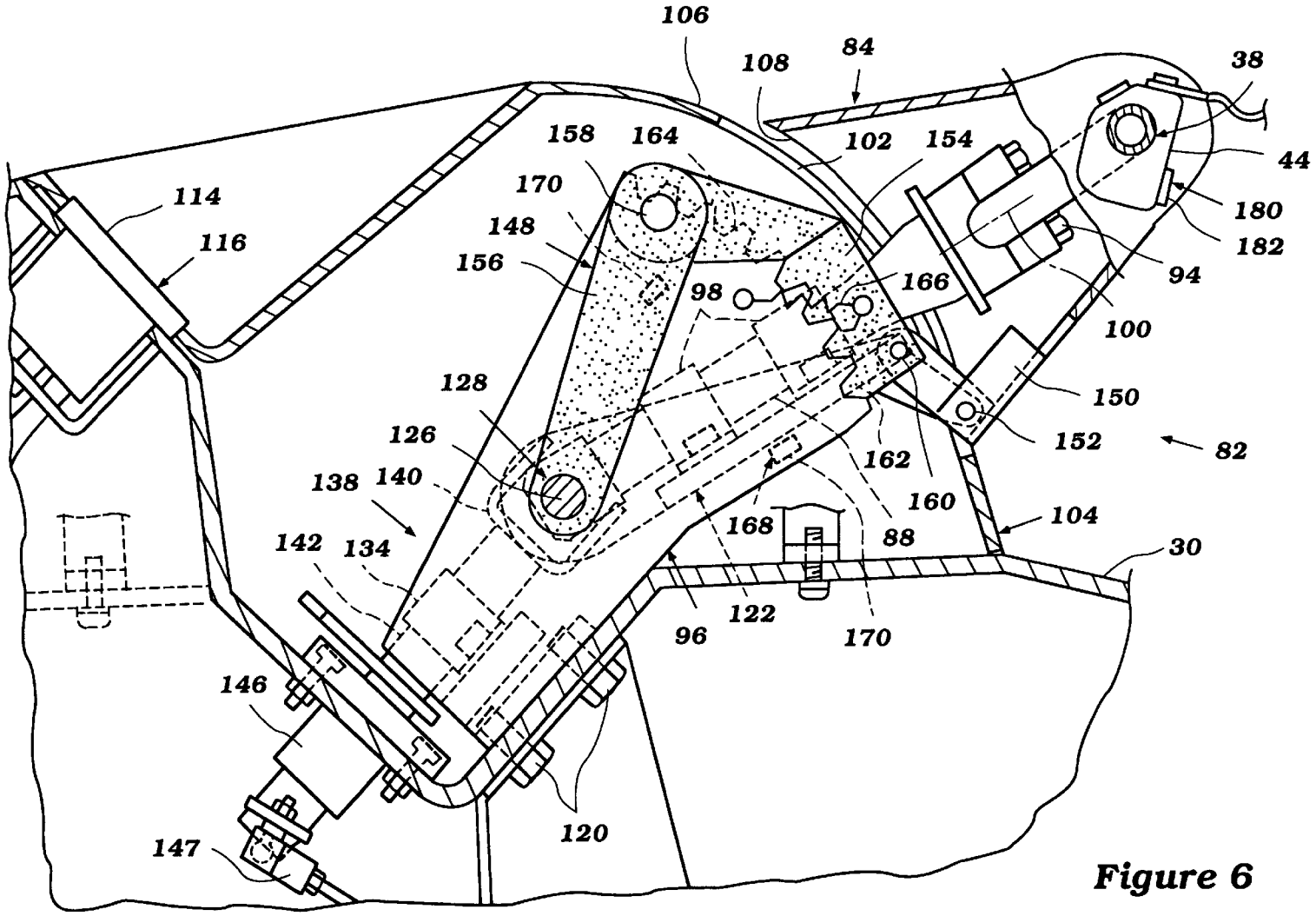
FIG. 6 is an enlarged side cross-sectional view of the adjustable steering mechanism of the watercraft of FIG. 1 in a rearward position.

As best illustrated in FIGS. 3 and 6 the rotation member 96 is mounted on top side of the upper wall 30 thereby avoiding the creating any holes for water to invade the engine compartment 54. The fasteners 120, for securing the rotation member, are typically of the threaded bolt type and are either secured with mating threaded nuts or internally threaded holes on a mounting bracket to be described later.

Figure 7:
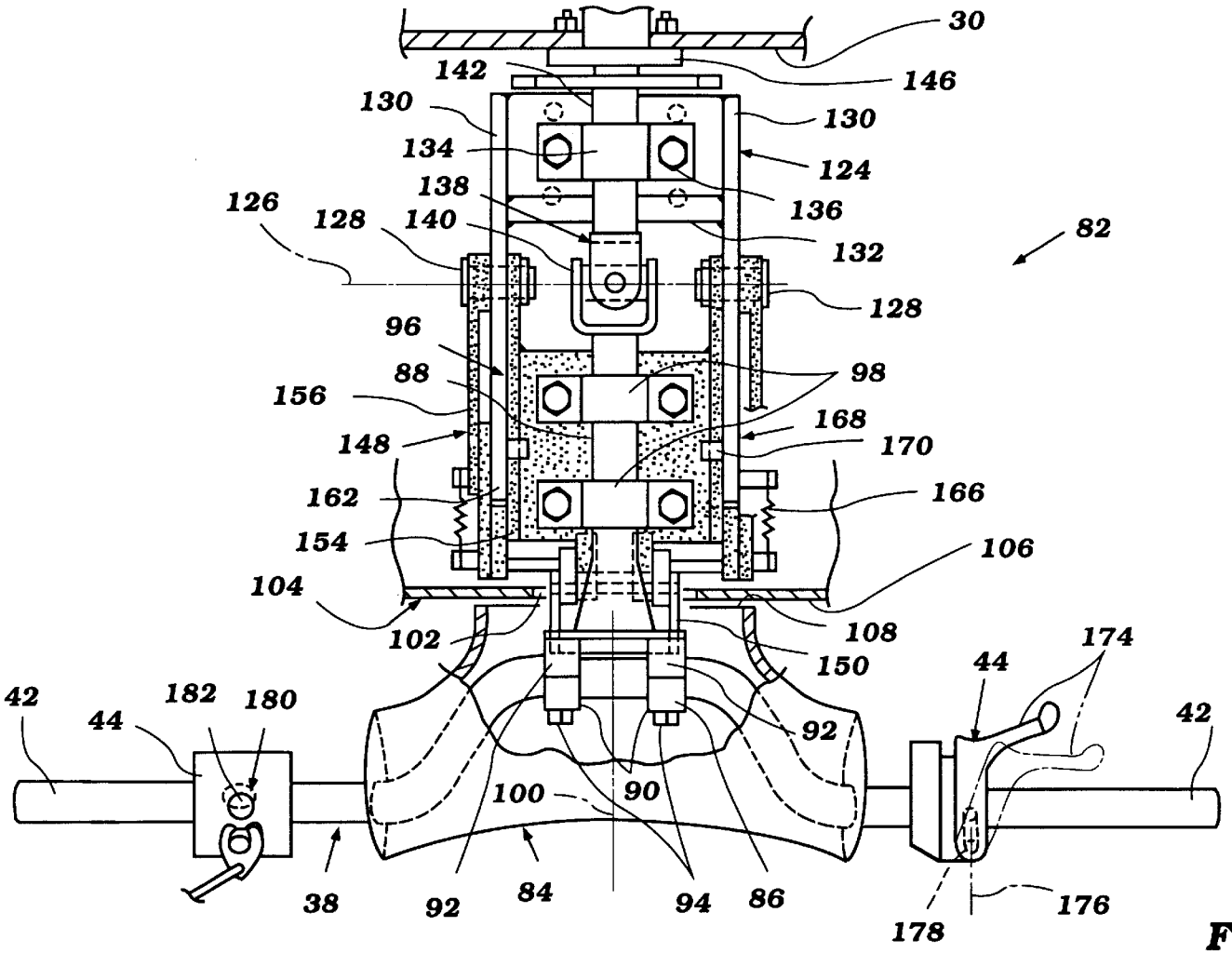
FIG. 7 is a partial plan view of the adjustable steering mechanism of the watercraft of FIG. 1.

In the embodiment illustrated in FIGS. 3–9 the rotating member 96 is comprised of a rotation portion or plate 122 and a fixed portion 124. As best illustrated in FIG. 7, the steering shaft 88 is fixed for rotation about axis 100 with the bearings 98 which are affixed to the rotation portion 122. The rotation portion 122 is affixed for rotation about a substantially horizontal axis 126. The axis 126 is generally perpendicular to the longitudinal axis of the watercraft 10. The rotation portion 122 is mounted for rotation with rotation shaft 128 which is in turn is mounted in the fixed portion 124. Thus, the steering shaft 88 can rotate or pivot in a forward and rearward direction with the rotation portion 122 and can rotate independently about axis 100.

The fixed portion 124 is preferably comprised of two side portions 130 which support the rotation portion for rotation adjacent to a bottom portion 132. The bottom portion 132 provides a mounting surface for the bearings 134 which supports the rotation of the first steering means which will be described below. The bearing 134 is attached to the bottom portion 132 with a plurality of bolts 136.

The first steering means 138 for all of the embodiments is attached to the steering shaft 88 and handle bar 38 and transfers the operator input to a mechanism such as the steering nozzle for the operation of the watercraft 10. The first steering means 138 must be able to accept input from the shaft 88 in all positions throughout the range of rotation 110. Further, at the point the first steering means 138 extends through the upper wall 30 there must be a fluid tight seal, for all rotations of the steering shaft 88, in order to prevent water from entering the engine compartment 54.

In the embodiment illustrated in FIGS. 3–9 the connection of the steering shaft 88 to the first steering means 138 is achieved with the use of a u-joint 140. The downward end of the u-joint 140 is connected to a second steering shaft 142 affixed for rotation by bearings 134 which are mounted on bottom plate 132. The axis of rotation of the u-joint 140 is aligned with the axis 126 in order to prevent binding when the u-joint 140 rotates with the rotation portion 122.

The second steering shaft 142 rotates about an axis 144 and is supported on a downward side by the bearing 146. The bearing 146 is mounted to bottom side of upper wall 30 and is located within the engine compartment 54. In the embodiment shown in FIGS. 3–7 a bracket extends from the downward portion of the second steering shaft 142 and rotates with the second steering shaft 142. The bracket is connected to a steering control element 147 which controls the steering of the watercraft 10 as is best illustrated in FIG. 3.

In order to fix the rotation of the rotation portion 122 and subsequently the rotation of the steering shaft 88 and handle bar 38 a locking means is provided and is generally referenced by the number 148. The locking means 148 must be easily accessible by the operator in the normal use of the watercraft 10. As best illustrated in FIG. 4, an operation arm 150 of the locking means 148 is rotatably connected to a first shaft 152. The shaft 152 allows for the rotation of the rotation of arm 150 about a generally horizontal axis of the shaft 152. The locking means 148 allows the rider to select a predetermined position. The predetermined positions are dictated by the spacing of the engaging mechanism as will be more fully described below.

The downward end of the arm 150 is connected to a second arm 154. The second arm 154 is connected to a third arm 156 on a downward side with a second shaft 158. The arm 150 is connected to the second arm by means of a rotation shaft 160. The third arm 156 is connected for rotation about the shaft 128.

The downward side of the second arm 154 includes a series of engaging teeth 162. The engaging teeth mate with another set of engaging teeth 164 of the side portions 130. In order to keep the teeth 162,164 engaged a spring 166 is mounted between the arm 154 and the side portion 130. The spring 166 is preferably designed to have enough force to keep the teeth 162,164 engaged but compliant enough to allow an operator to separate the teeth 162,164 in order to effect an adjustment of the steering mechanism 82.

Stopper means 168 prevent the rotation portion 122 and thus the rotation of the steering shaft 88 and the handle bar 38 and the subsequent controls from rotating beyond a point that makes the controls difficult to operate. The stopper means 168, in the embodiment shown in FIGS. 3–9, includes stoppers 170 which are mounted on the side portion 130. In this embodiment there are a total of four stoppers 170. The stoppers 170 are either separate pieces or are integrally formed with the side members 130. Preferably the stoppers 170 are covered with an elastomeric material. The stoppers 170 effectively restrict the travel of the rotating portion 122 and thereby restrict the movement of the handle bar 38 and attached controls. Preferably the stoppers 170 are spaced on the side portion 130 so that the handle bar 38 cannot be moved into a position were the display panel 116 cannot be seen by the operator or the controls are difficult to use.

The operation of the adjustable steering mechanism 82 of the embodiment shown in FIGS. 3–9 works as follows. As best illustrated in FIG. 4, the operator pulls on the operation arm 150 thereby causing a rotation about the shaft 152. The lower end of the arm 150 then rotates in an upward direction and imparts a similar displacement on the shaft 160 thereby moving arm 154 upward. The movement of the arms is illustrated in phantom. Upon movement of the arm 154 the arm 156 is rotated about shaft 128.

Once the arm 154 is moved away from the side plate 130 the engaging teeth 162,164 are no longer in contact thereby allowing the rotating portion 122 to freely rotate within the range 110. Once the operator has selected a desired location of the handle bar 38 he merely releases the operating arm 150. Upon the release of arm 150, the spring 166 will pull the arm 154 toward the side portions 130 thereby engaging the teeth 162,164. Subsequently, the operating arm 150 will return to its original orientation as will arm 156.

Figure 8:
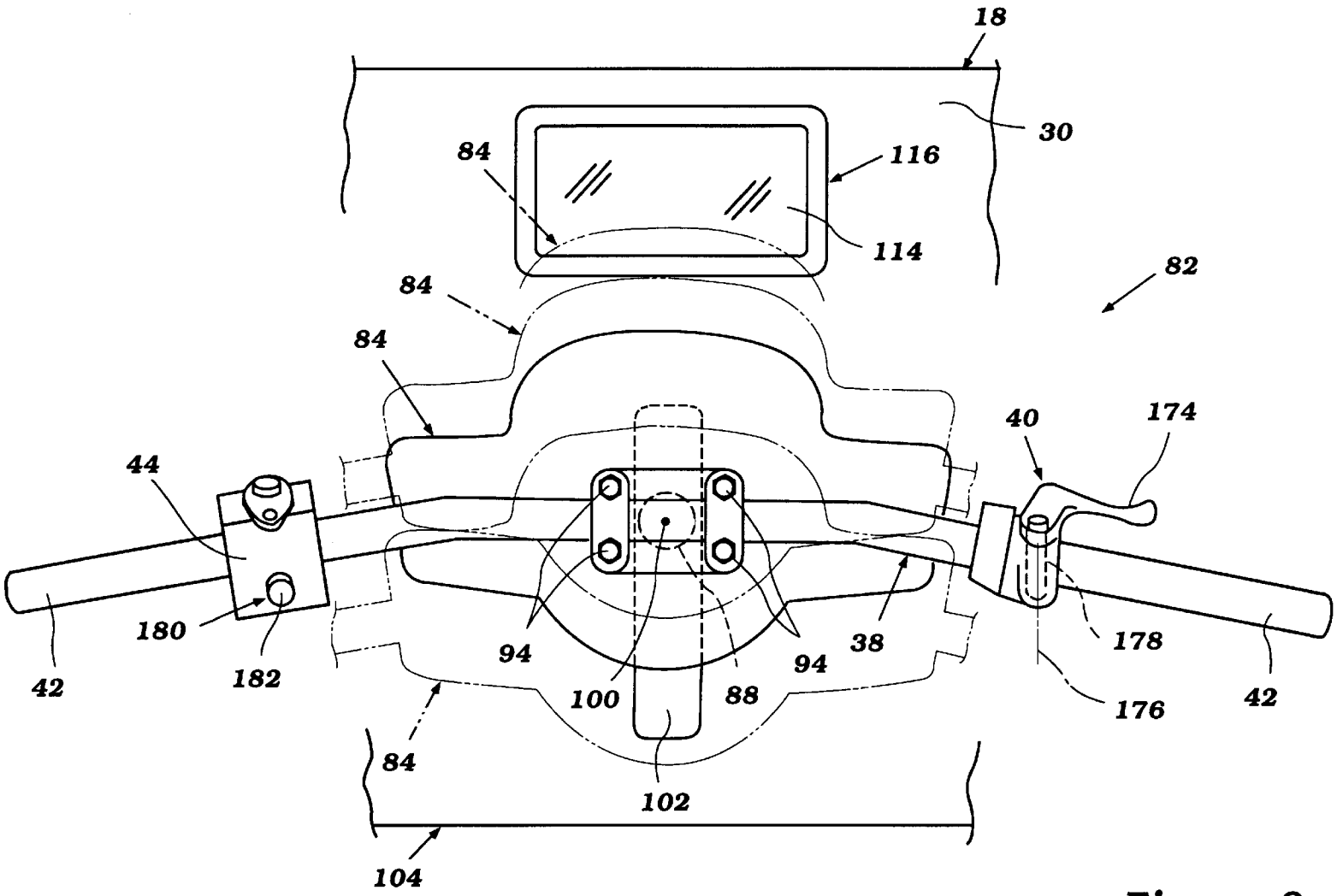
FIG. 8 is a partial plan view of the handle bar assembly of the watercraft of FIG. 1 showing the various positions of the handle bar assembly in phantom.

The range of operation of the adjustable steering mechanism 82 is best shown in FIG. 3. The range of rotation 110 of the handle bar 38 and steering shaft 88 is shown in phantom in the full forward location as well as in the full rearward location. The display 116 has an upper and a lower edge as best illustrated in FIG. 8. The display 116 also has a substantially planar surface. A plane 172, in FIG. 5, defines a plane extending through the lower edge of the display and is substantially perpendicular to the face of the display 116.

Figure 5:
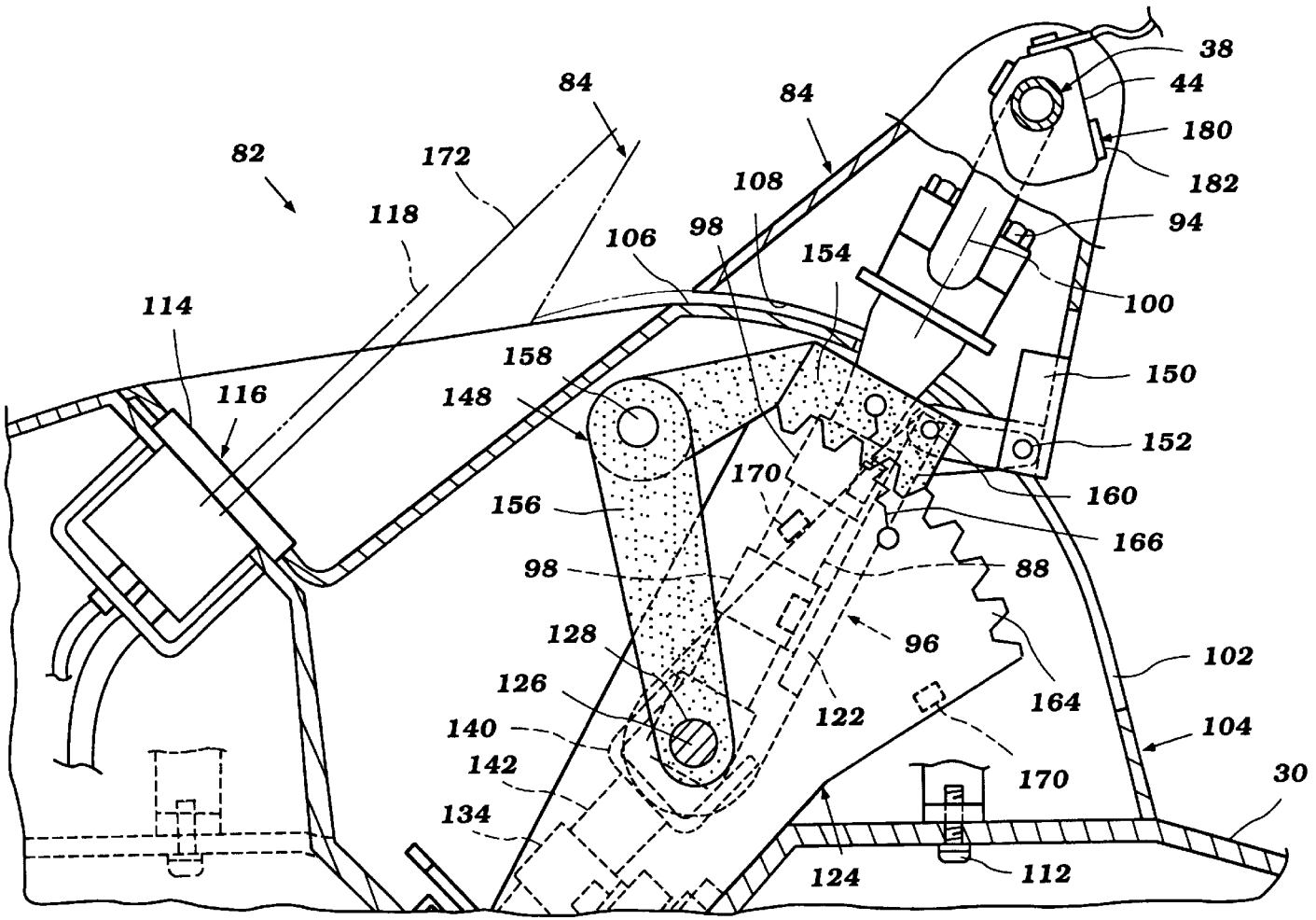
FIG. 5 is an enlarged side cross-sectional view of the adjustable steering mechanism of the watercraft of FIG. 1 in a forward position.

When in the full forward location the front edge of the pad 84 will partially cover the display 116 and be positioned at least partially forwardly of plane 172, as is best illustrated in FIG. 5 and FIG. 8. When the steering shaft 88 and the handle 38 are in pivoted in a rearward direction the front edge of the pad 84 is positioned rearwardly of the plane 172. The display 116, however, is always visible to the operator of the watercraft 10 during the full range of travel.

Various positions of the steering mechanism 82 of the embodiment of FIGS. 3–9 are illustrated. FIG. 3 illustrates the full range of travel 110 with both the forward most and rearward most limits of the ranges shown in phantom. FIG. 5 illustrates the mechanism 82 in a forward position in solid line and a full forward position in phantom. The mechanism 82 is shown in a rearward position in FIG. 6. The full downward position is marked by the rotation portion 122 contacting the stopper 170. During the full range of travel the pad 84 blocks a portion of the slot 102 and at least partially prevents the ingress of water into the cover 104.

Figure 9:
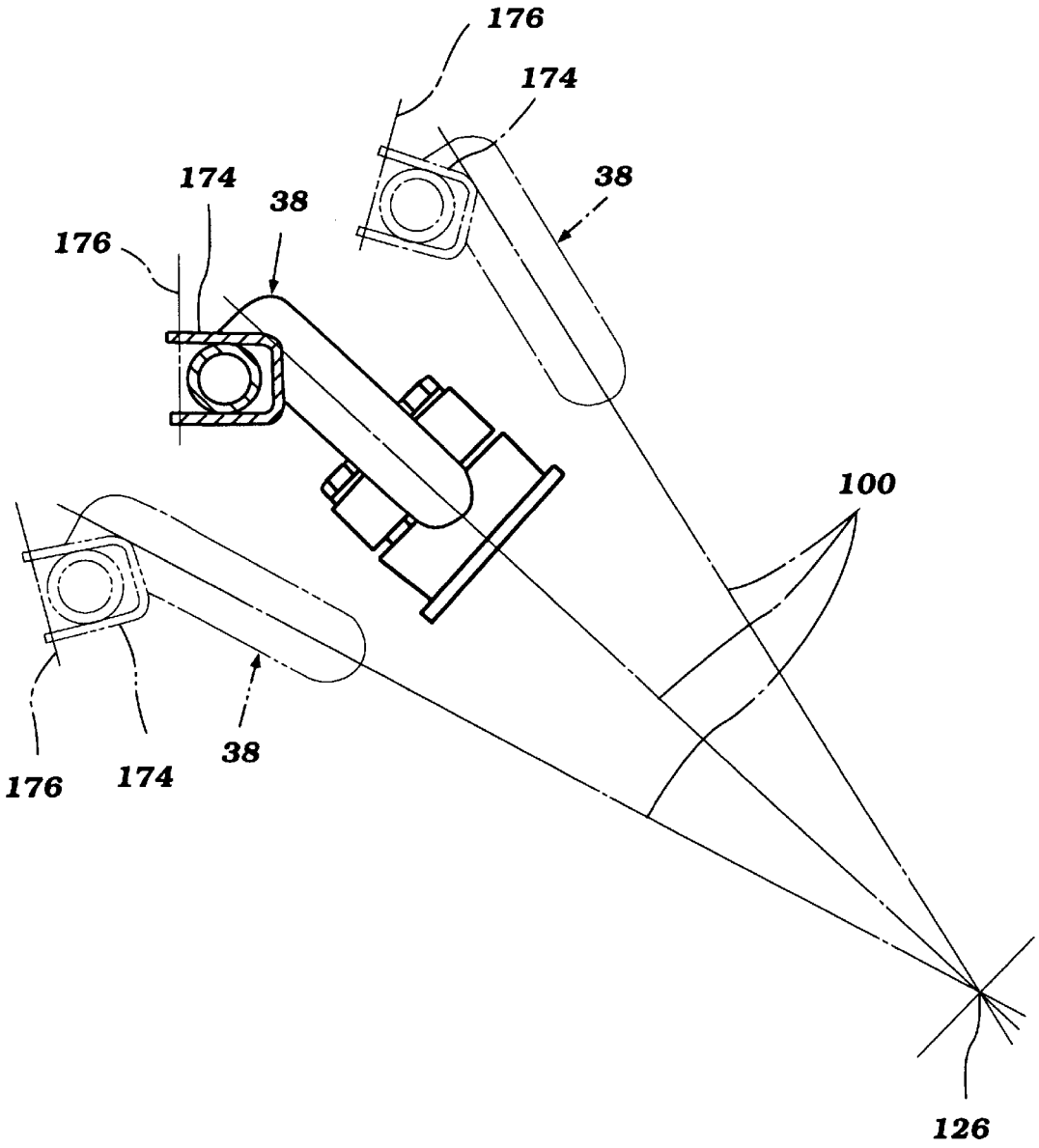
FIG. 9 is a partial side view of the handle bar assembly of the watercraft of FIG. 1 showing the various positions of the handle bar assembly in phantom.

FIGS. 8 and 9 illustrate that the controls are in accessible orientations throughout the full range of travel. As best illustrated in FIGS. 7 and 8 the throttle 40 includes a throttle lever 174 which rotates about an axis 176 of shaft 178. In order to ensure that the throttle 44 is easy to operate in all of the positions of the steering mechanism 82 it is desirable that the shaft 178 be substantially vertical during at least one point in the range of travel 110. In particular, the shaft 178 is substantially vertical in a rearward rotation as shown in FIG. 9.

In addition to the throttle being easy to operate during the forward and rearward operation of the steering mechanism 82 the control switch 44 must be easy to operate. As shown in FIG. 8, the control switch includes an engine control button 180 defining a pressure pad 182. The pressure pad 182 is pressure sensitive and is used to turn off the engine 58 when pressed. In order to provide adequate operator comfort when using the control button 180 the plane defined by the surface of the pad 182 must be substantially vertical during at least one point during the rotation range of the adjustable steering mechanism 82. In particular, the plane of the pad 182 must be substantially vertical during a rearward rotation of the steering shaft 88 and handle bar 38.

Figure 10:
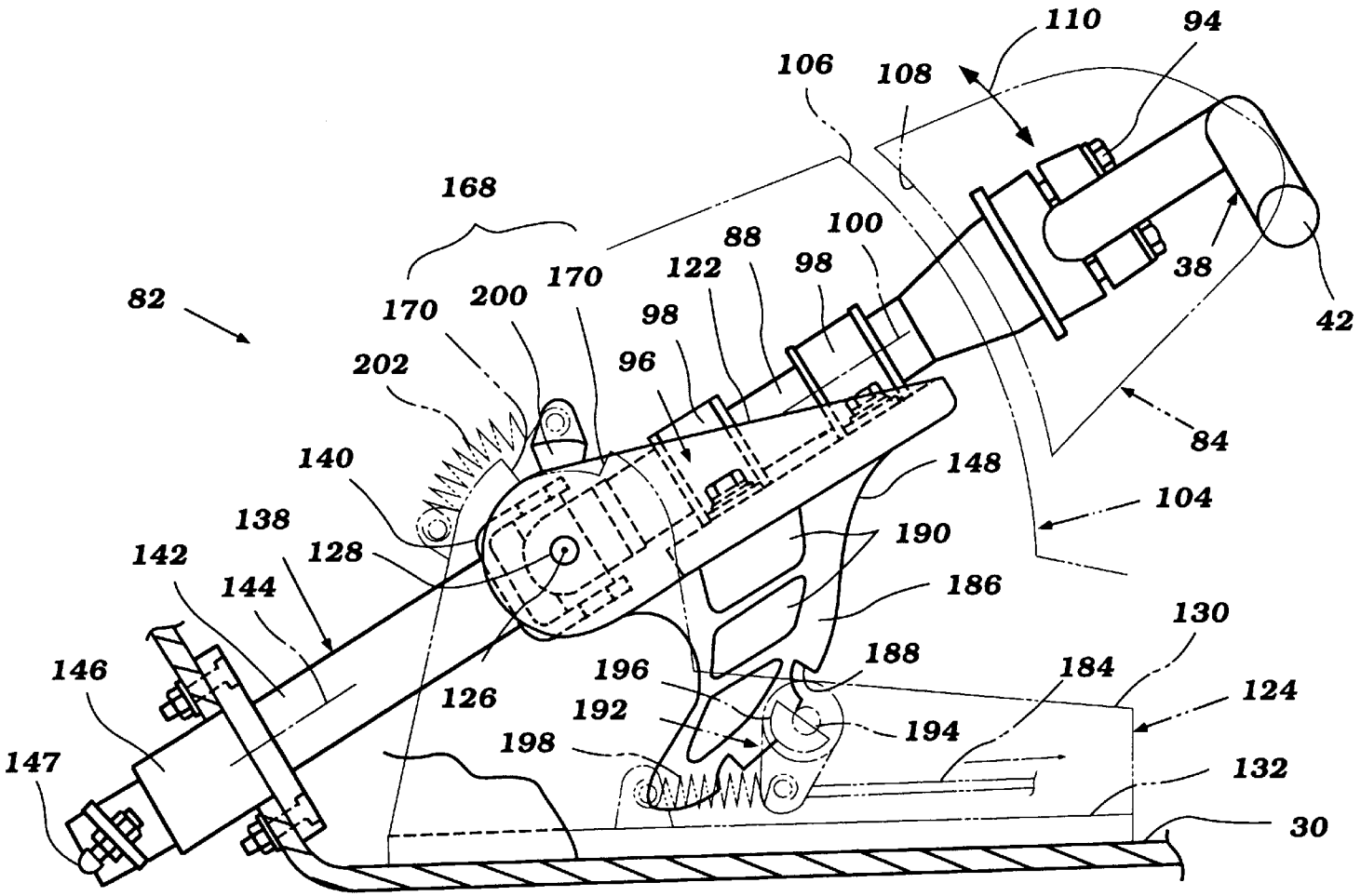
FIG. 10 is a partial side view with parts shown in cross-section and in phantom of another embodiment of the adjustable steering mechanism of the watercraft of FIG. 1.

Another embodiment is illustrated in FIG. 10. For ease of understanding the reference numerals for all of the similar elements are the same as the previous embodiments. When the operator wants to change the positioning of the steering mechanism 82 he would pull a control means (not shown). In this embodiment the control means is connected to a control wire 184. The control wire 184 is connected to the locking means 148. The locking means 148 are comprised of an arm 186 with teeth 188 on the bottom side thereof. In order to keep the weight of the arm 186 low there are several lightening holes 190 provided. The wire 184 is connected to an engaging arm 192 which rotates about a shaft 194. Also located on the engaging arm 192 is an engaging tooth 196. The tooth 196 cooperates with the teeth 188 to lock the rotation member 96 at the desired location. When the operator releases the control wire 184 a spring 198 rotates the engaging arm 192 in order the lock the mechanism.

As with the previous embodiment the handle bar 38 and steering shaft 88 are rotatably affixed to a rotation member 96. A plurality of bearings 98 mount the steering shaft 88 on a rotation portion 122 of the rotation member 96. The lower end of the steering shaft 88 is connected to a u-joint 140 that prevents binding when the angle of steering shaft is changed.

The rotation member 122 is sandwiched between the side portions 130 of the fixed portion 124. The bottom portion 132 is substantially parallel and mounted to the top of the upper wall 30.

The first steering means 138 is connected to the bottom side of the u-joint 140. In this embodiment, the first steering means 138 is comprised of a steering shaft 142 which rotates about an axis 144. The steering shaft 142 extends through the wall 30 and into the engine compartment 54. Bearing means 146 are mounted on a bottom side of panel 30 and rotatably support the steering shaft 142 in a conventional manner. Preferably there is a water tight seal between the bearing 146 and the upper wall 30 in order to prevent water from entering the engine compartment 54.

As in the previous embodiment, the lower end of the steering shaft 142 is connected to a steering mechanism (not shown) which is connected to the steering nozzle 80 and thereby controls the watercraft 10.

In order to define the range of travel 110 of the steering mechanism 82 a stopper means 168 is provided. The stopper means 168 for this embodiment consists of protrusion 200 extending from the rotating portion 122. The protrusion 200 extends into an arcuate groove in the fixed portion 124. The on the end of the grooves are located two stops 170 which abut the protrusion 200 and thereby limit the rotation of the rotation portion 122.

In order to provide for easy rotation of the rotation member 122 a spring 202 is provided. The spring 202 is connected to the protrusion 200 on one end and to the fixed portion 124 on the other end to provide a counter balance to the weight of the steering shaft 88 and handle bar 38.

Figure 11:
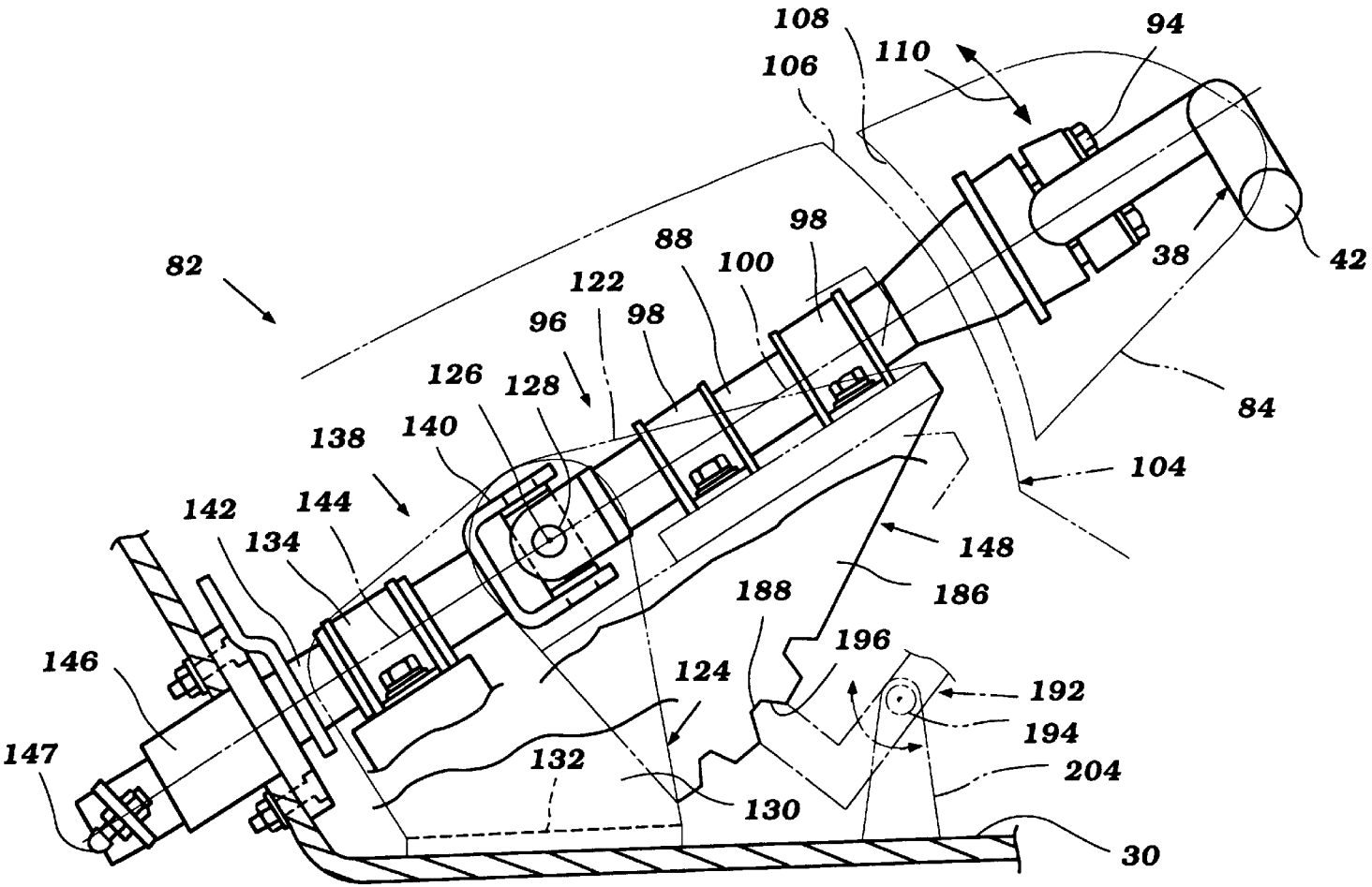
FIG. 11 is a partial side view with parts shown in cross section and in phantom of yet another embodiment of the adjustable steering mechanism of the watercraft of FIG. 1.

Another embodiment of the adjustable steering mechanism is shown in FIG. 11. This embodiment is very similar to the embodiment of FIG. 10. As before, the numerals referencing common parts will be maintained. In this embodiment the operator would pull a control line (not shown) which is attached to engaging arm 192. The engaging arm 192 rotates about a shaft 194 which is rotatably supported in a bracket 204. The downward end of the engaging arm 192 comprises a tooth 196 configured to releasably engage mating teeth 188 in the arm 186. Thus, upon the release of the control wire the arm 192 engages the arm 186 connected to the rotation portion 122.

As in the previous embodiment, the embodiment shown in FIG. 11 has a steering shaft 88 which terminates in a u-joint 140. The pivot axis of the u-joint 140 is aligned with the axis of the shaft 128 of the rotation member 96. The opposite side of the u-joint 140 is connected to a second steering shaft 142 rotating about the axis 144. The second steering shaft 142 is journalled by the bearing 134 in a conventional manner. Also, the second steering shaft 142 extends through the upper wall 30 and into the engine compartment 54. Bearing means 146 are mounted on a bottom side of panel 30 and rotatably support the steering shaft 142 as in a conventional manner. Preferably there is a water tight seal between the bearing 146 and the upper wall 30 in order to prevent water from entering the engine compartment 54. As in the previous embodiments the lower end of the second steering shaft 142 is connected to a steering controller through means 147.

Further, this embodiment, as well as all of the remaining embodiments, incorporates stopper means (not shown) in order to limit the rotation member 96 to desired positions.

Figure 12:
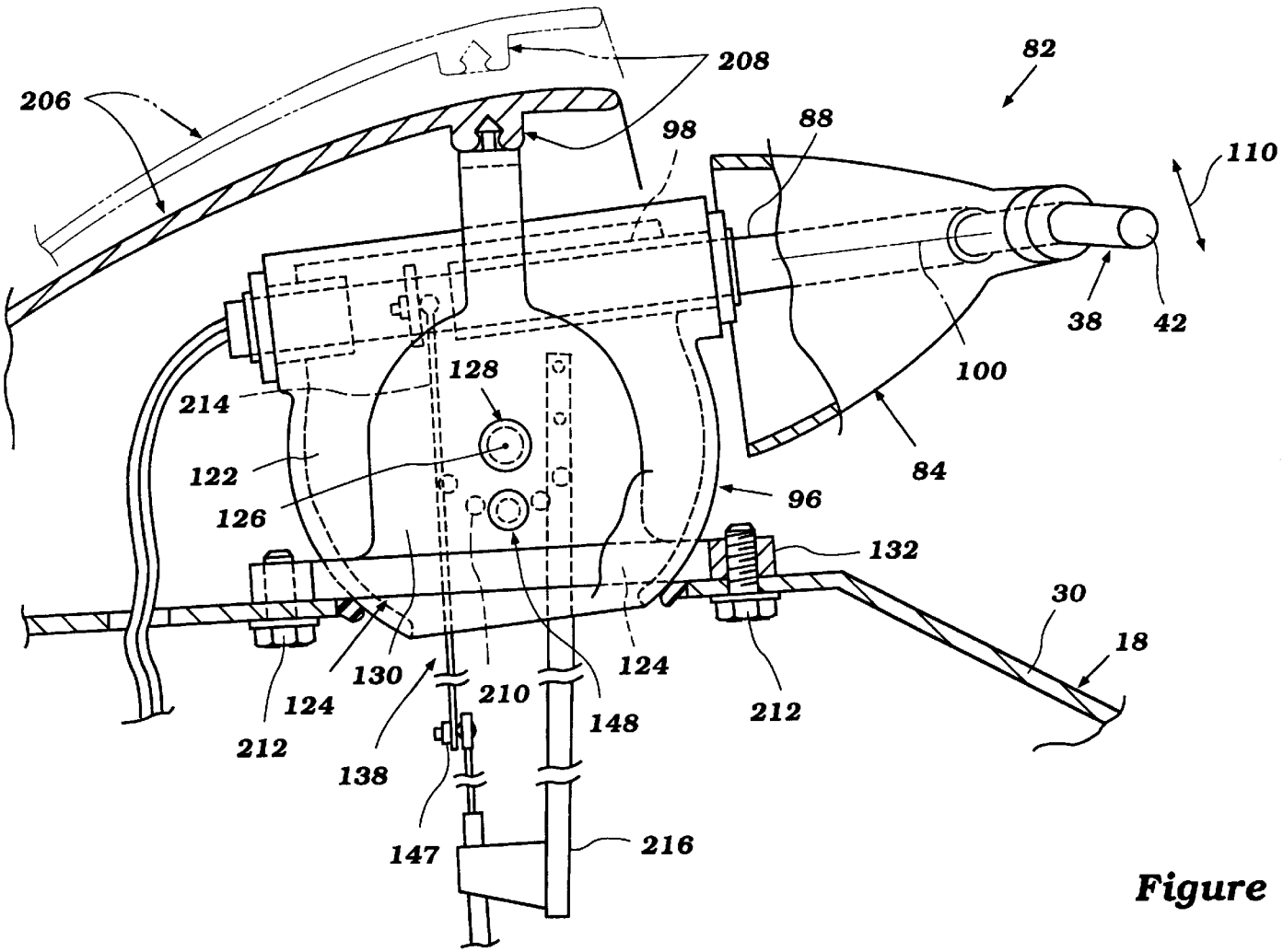
FIG. 12 is a partial side view with parts shown in cross section and in phantom of still another embodiment of the adjustable steering mechanism of the watercraft of FIG. 1.
Figure 13:
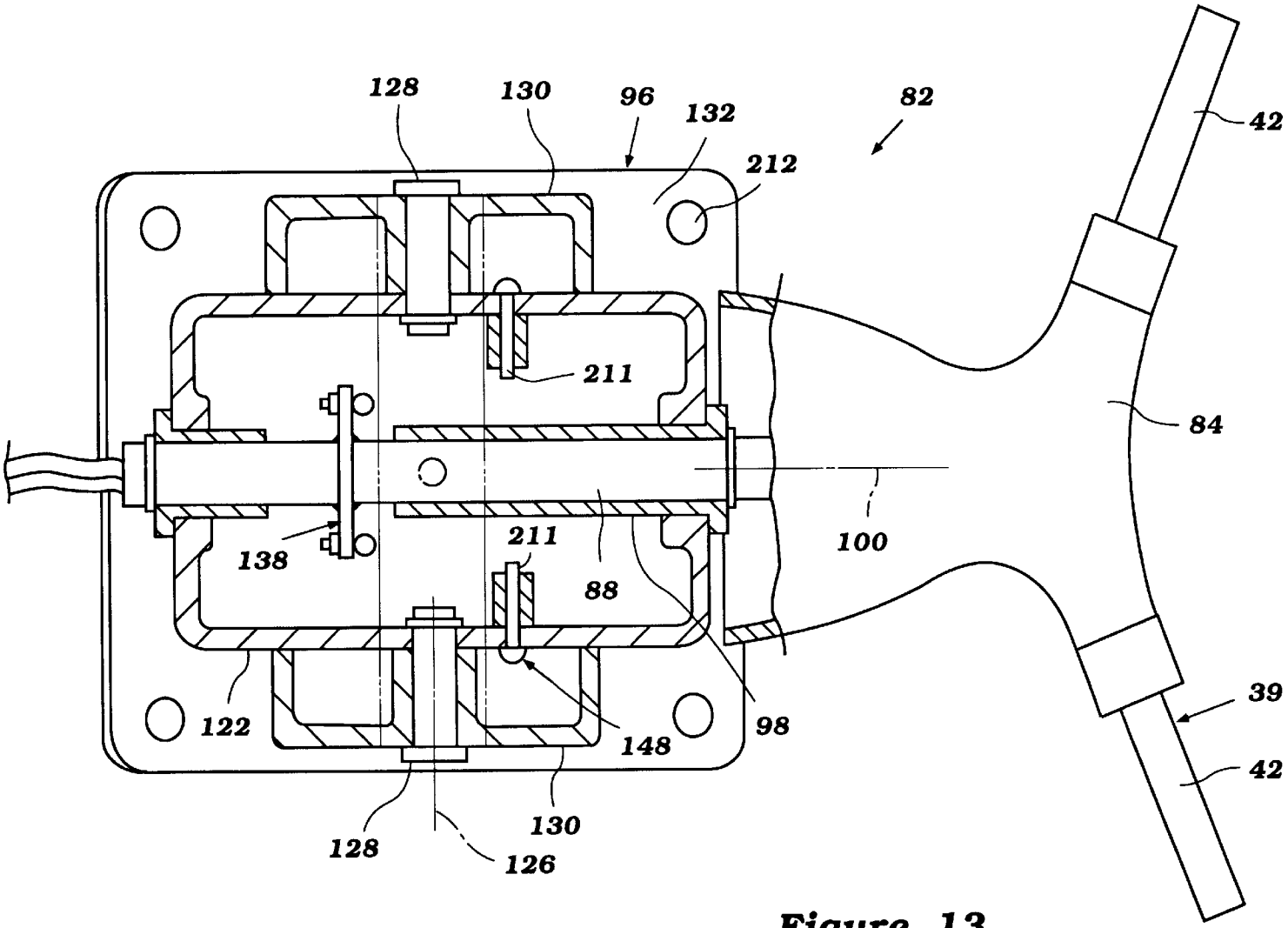
FIG. 13 is a partial plan view of the handle bar assembly of the adjustable steering mechanism of the embodiment illustrated in FIG. 12.

Still another embodiment is shown in FIGS. 12 and 13. As before, the common elements between the embodiments will retain their original numbers. The steering shaft 88 and handle bar 38 are rotatably supported in the rotation member 96. The rotation member is comprised of rotation portion 122 and a fixed portion 124. The rotation portion 122 rotates about the axis 126 of the shaft 128 and is sandwiched in the side brackets 130. The bottom portion 132 of the fixed portion 124 is connected on a top side of the upper wall 30 with a plurality of bolts 212. Further, a hatch portion 206 is releasably attached to a top portion of the fixed member 124 by a securing means 208 as is well known in the art.

In this embodiment the structure of the locking means 148 is comprised of several holes 210 on the fixed portion 124. These holes 210 are designed to receive a pin 211, shown in FIG. 13, which is located on the rotation portion 122. In order to release the locking mechanism 148, the pin 211 is pulled out of the hole 210 and the rotating portion 122 is positioned at a point in alignment with a desired hole 210 and then the pin is replaced. It is conceivable that the pin 211 is spring loaded in that the operator would pull the pin out of the hole 210 and the compression force of the spring would replace the pin once the operator had selected the desired position.

The first steering means 138 is connected to the steering shaft 88 and extends into the engine compartment 54 through an opening in the upper wall 30. The first steering means in this embodiment is comprised of a shaft 214 that is coupled to the steering shaft 88 on an upper end and to a steering controller 147 on a lower end. The shaft 214 is supported by bracket 216 to maintain orientation of the shaft 214 when the rotating portion 122 is rotated.

Further, this embodiment, as well as the remaining embodiments, incorporates locking means (not shown) in order to fix the rotation member 96 in a desired position and to provide an ergonomical placement of the throttle 42 and the switch box 44.

Figure 14:
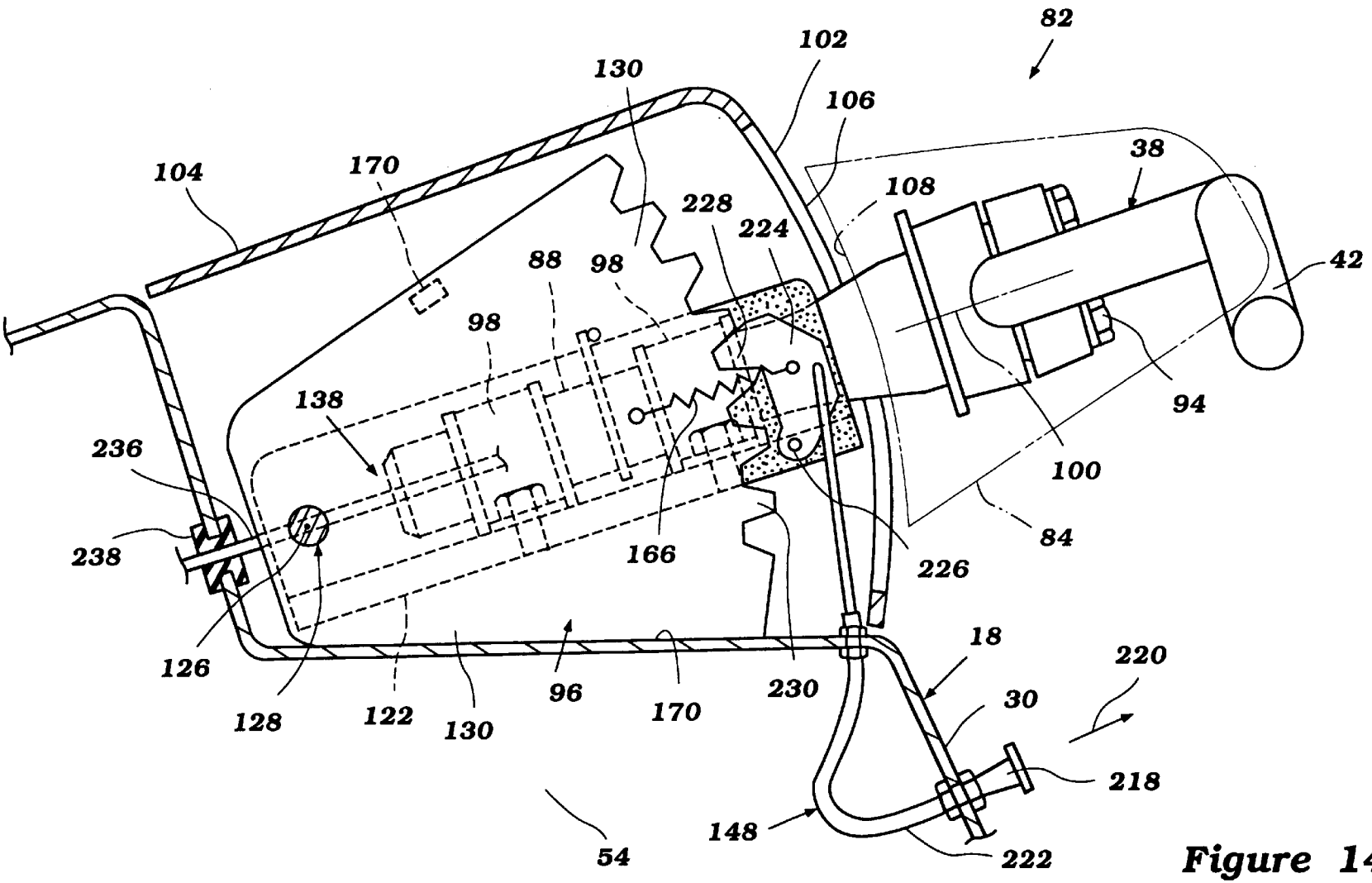
FIG. 14 is a partial side view with parts shown in cross section and in phantom of another embodiment of the adjustable steering mechanism of the watercraft of FIG. 1.

Still another embodiment is illustrated in FIGS. 14 through 18. As before, the numbers will remain consistent for elements that are the same as the previous embodiments. As best illustrated in FIG. 14, in order for the operator to adjust the level of the steering handle bar 38 he must first release the locking means 148. The operator must pull knob 218 in the direction of arrow 220.

The knob 218 is connected to a sheathed cable 222 which extends through the wall 30 and into the engine compartment 54. The cable 222 is connected at an opposite end to a locking arm 224 rotating around the shaft 226. At the opposite end of the engagement arm is a tooth 228 designed to engage with the a plurality of engaging teeth 230 in order to secure the rotation portion 122. As similar to the previous embodiments a spring element 166 keeps the arm 224 engaged to the side portions 130.

As in the previous embodiments the steering shaft 88 and the handle bar 38 are rotatably affixed to the rotating portion 122 of the rotation member 96 with a plurality of bearings 98 as is known in the art. The rotation portion 122 is pivotally mounted in the fixed portion 124 with the shaft 128 and is free to pivot about the axis 126 when the locking mechanism 148 is released.

Figure 15:
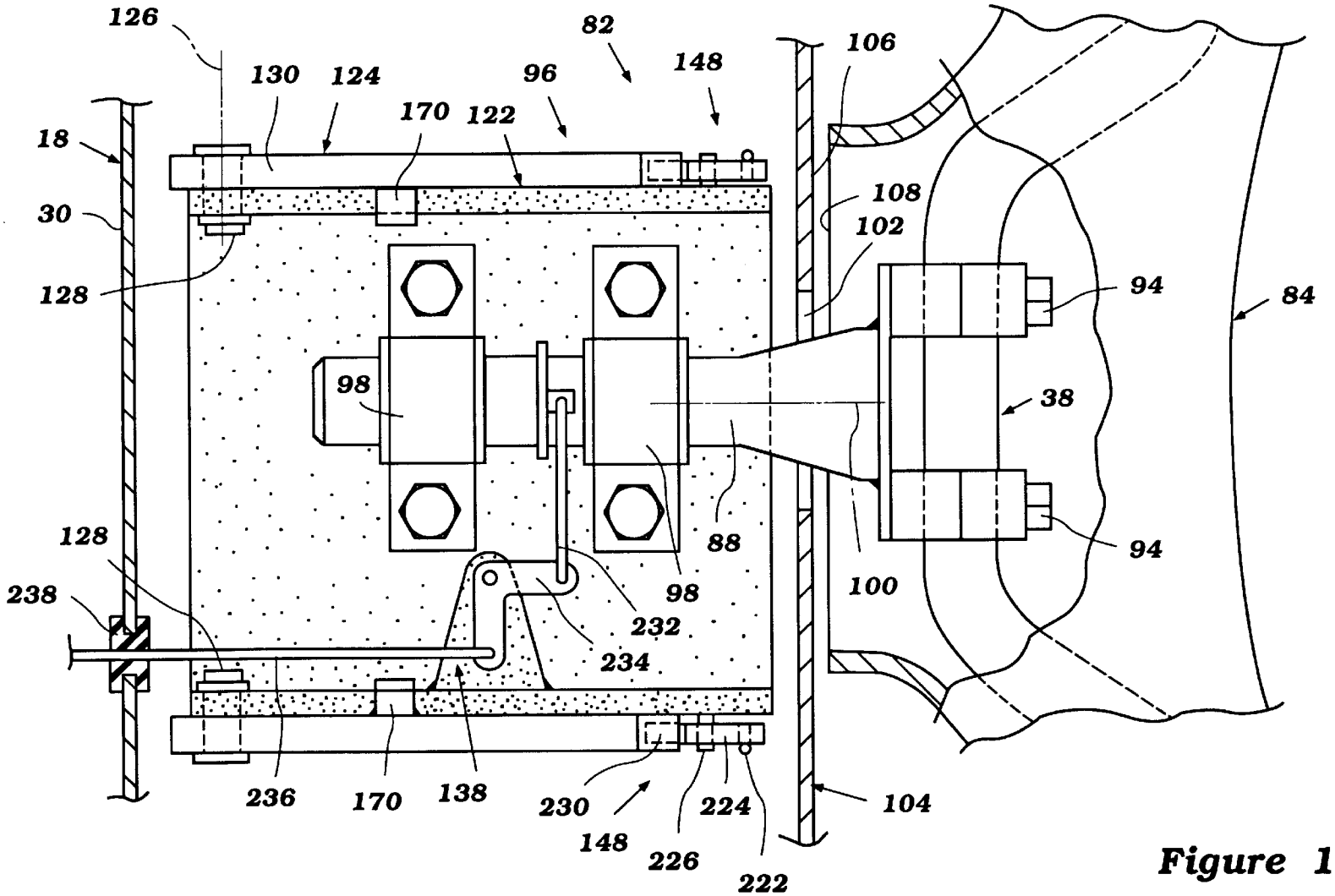
FIG. 15 is a partial plan view of the handle bar assembly of the adjustable steering mechanism of the embodiment illustrated in FIG. 14.

The first steering means 138 as best illustrated in FIG. 15 is comprised of a multiple link system. The first link 232 is connected to bracket on the steering column 88. The opposite end of the first link 232 is connected to a rotating bracket 234 that is rotatably mounted on the rotating portion 122. The rotating bracket 234 translates the rotational movement of the steering shaft 88 into forward and rearward movement. The rotating bracket 234 is also connected to a second link 236. The second link extends through the upper wall 30 and into the engine compartment 54 where it is connected to a steering controller (not shown). Preferably a seal 238 is located in the upper wall 30 providing a watertight seal and preventing water from entering the engine compartment 54.

Figure 16:
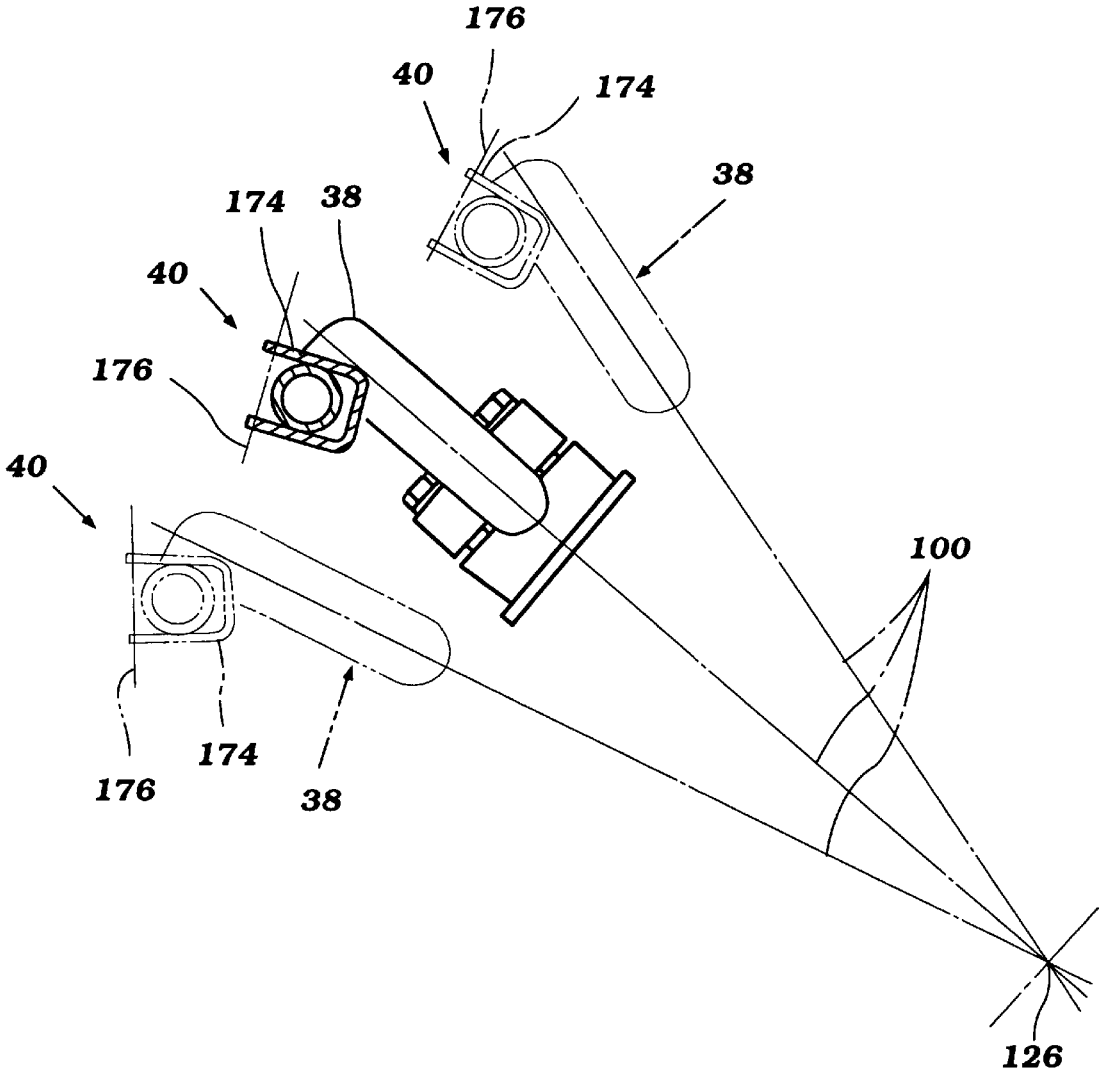
FIG. 16 is a partial side view of the handle bar assembly of the watercraft of FIG. 1 showing the various positions of the handle bar assembly in phantom.

FIGS. 15 and 16 illustrate that the controls are in accessible orientations throughout the full range of travel. As best illustrated in FIG. 16 the throttle 40 includes a throttle lever 174 which rotates about an axis 176 of shaft 178. In order to ensure that the throttle 44 is easy to operate in all of the positions of the steering mechanism 82 it is desirable that the shaft 178 be substantially vertical during at least one point in the range of travel 110. As shown in phantom, the vertical shaft 176 is substantially vertical when the handle bar 38 is in the rearward most position.

Figure 17:
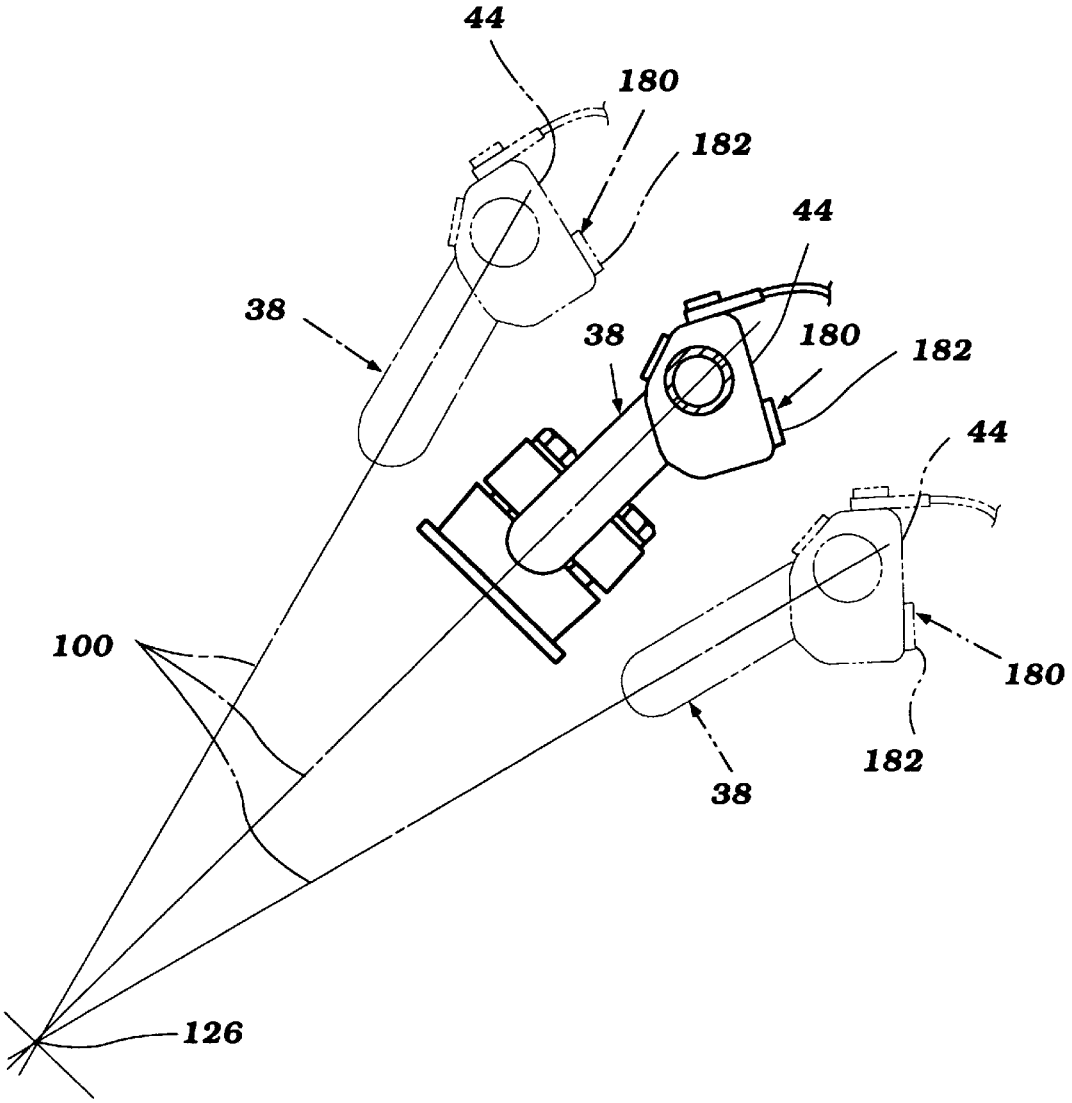
FIG. 17 is a partial side view of the handle bar and control assembly of the watercraft of FIG. 1 showing the various positions of the handle bar assembly in phantom.

In addition to the throttle being easy to operate during the forward and rearward operation of the steering mechanism 82 the control switch 44 must be easy to operate. As shown in FIG. 17 the control switch includes an engine control button 180 defining a pressure pad 182. The pressure pad 182 is pressure sensitive and is used to turn off the engine 58 when pressed. In order to provide adequate operator comfort when using the control button 180 the plane defined by the surface of the pad 182 must be substantially vertical during at least one point during the range of the adjustable steering mechanism 82. As illustrated in phantom in FIG. 17 the steering pad 182 is substantially vertical when the handle bar 38 is in the full rearward position.

Figure 18:
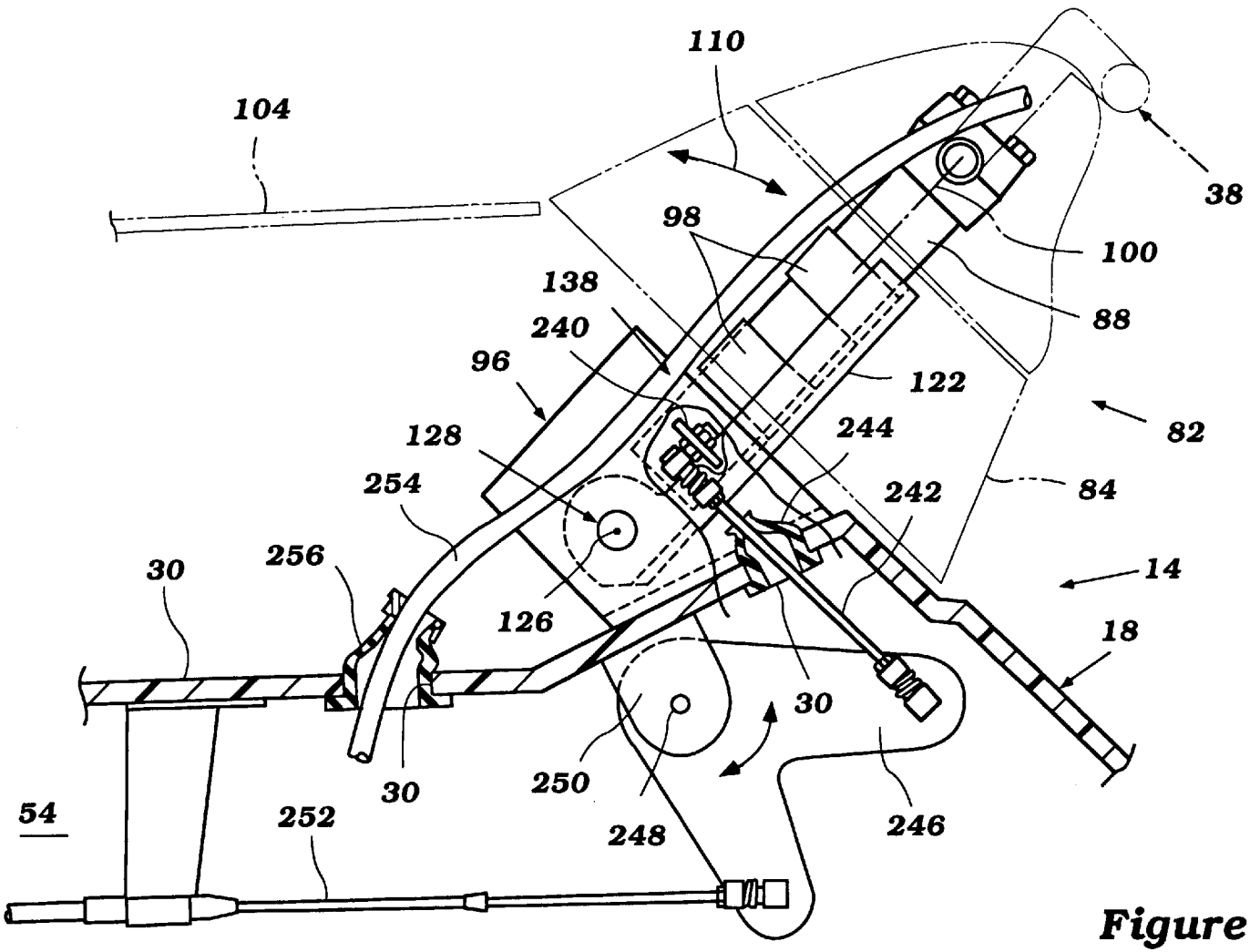
FIG. 18 is a partial side view with parts shown in cross section and in phantom of still another embodiment of the watercraft of FIG. 1.

Still another embodiment is illustrated in FIG. 18. As with the previous embodiments numeral references to similar elements are not changed. This embodiment works similarly to the previous embodiment in that the steering shaft 88 and the handle bar 38 are rotatably mounted to a rotation portion 122 of a rotation member 96. The rotating portion 122 rotates about a substantially horizontal axis 126 and is mounted to the fixed portion 124 through shaft 128.

Referring to FIG. 18 the first steering means 138 will now be described in detail. The first steering means 138 is comprised of a bracket 240 rigidly attached to the steering shaft 88. The bracket 240 is also attached to a link 242. The link 242 extends through the upper wall 30 and into the engine compartment 54. Preferably the wall incorporates a sealing member 244 which provides a watertight seal thereby keeping water out of the engine compartment 54. The link 242 translates the rotation of the steering shaft 88 into a rotating bracket 246. The rotation bracket 246 rotates about a shaft 248 on bracket 250. The rotation bracket 246 transmits the rotation into a steering control shaft 252.

Also mounted near the steering shaft 88 is a power cable 254 which runs from inside the motor compartment 54 and to the display 114. Preferably a seal 256 is incorporated in the wall 30 to provide a watertight seal and prevent water from entering into the engine compartment 54.

Figure 19:
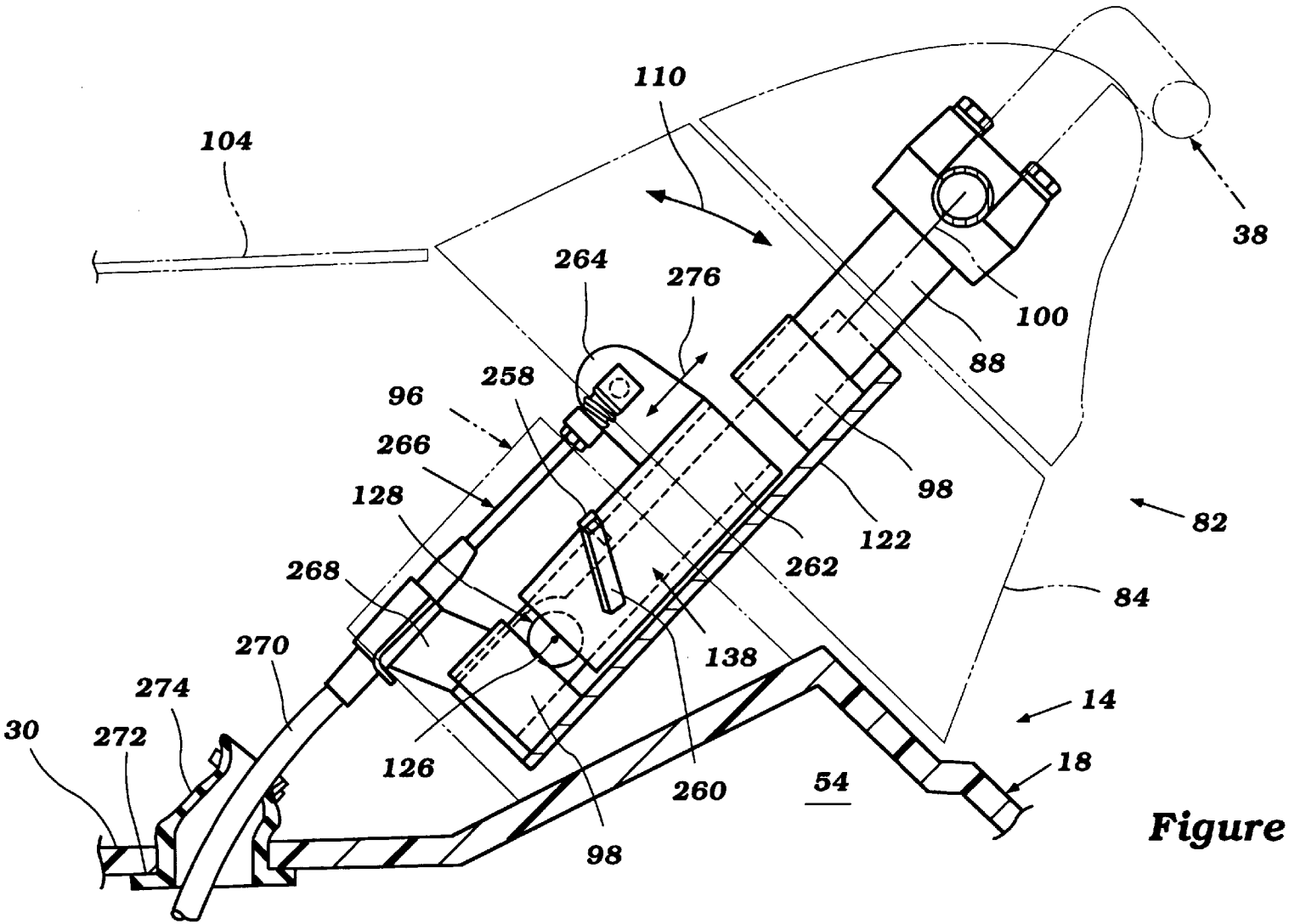
FIG. 19 is a partial side view with parts shown in cross section and in phantom of yet another embodiment of the adjustable steering mechanism of the watercraft of FIG. 1.
Figure 20:
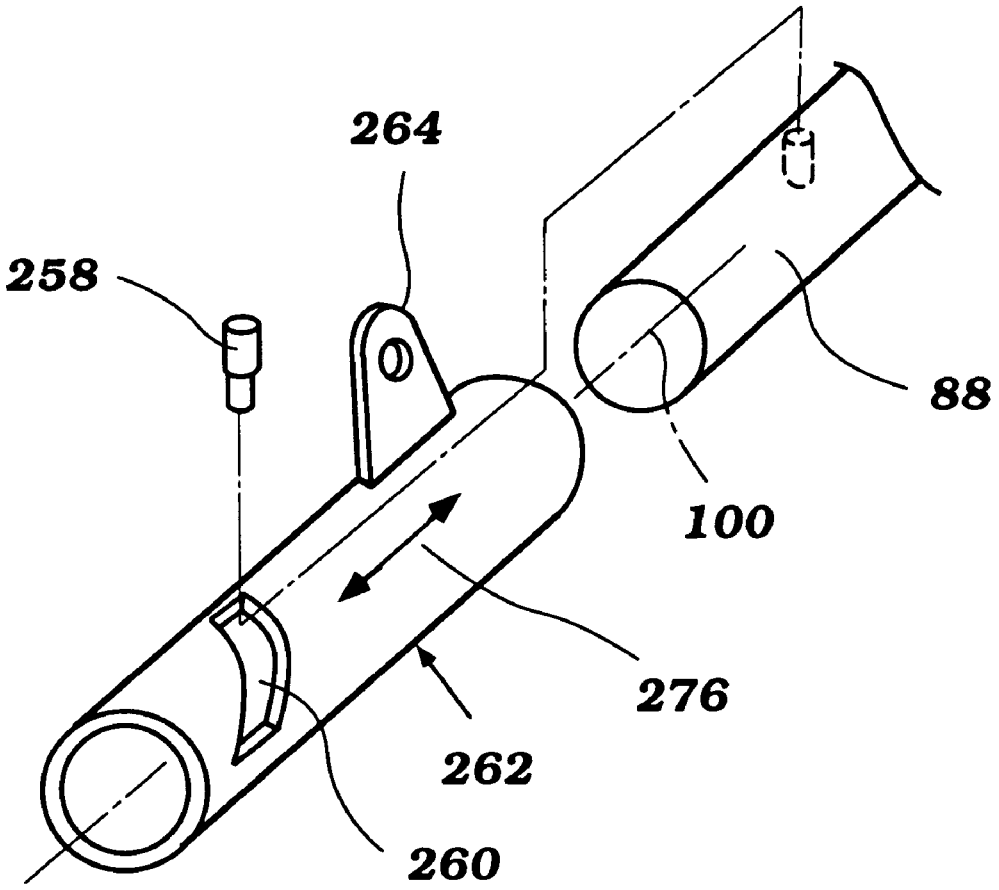
FIG. 20 is an exploded isometric view of the steering column of the adjustable steering mechanism illustrated in FIG. 19.

Still another embodiment is illustrated in FIGS. 19 and 20. As with all of the embodiments, similar elements will maintain the same reference number. As best illustrated in FIG. 19 the handle bar 38 and steering shaft 88 are rotatably mounted with bearings 98 on a rotation portion 122 of the rotation member 96. The rotation portion 122 rotates about axis 126 and is mounted to a fixed portion (not shown) by shaft 128.

The first steering means 138 for this embodiment will now be discussed. Referring to FIG. 20, a cam element 258 is affixed to the steering shaft 88. The cam element 258 is designed to ride in the cam slot 260 of the sleeve 262. A bracket 264 is affixed to travel with the sleeve 262. A link or shaft 266 is attached to the bracket 264 on one end. The link or shaft 266 is supported by the bracket 268. The sheath 270 then surrounds the link 266 as it extends through a through hole 272 in the wall 30. The through hole 272 is fitted with a rubber seal 274 to prevent water from entering the engine compartment 54.

When the operator turns the steering shaft 88 the cam 258 moves along the slot 260 and causes the sleeve 262 to travel up and down the steering shaft 88 in the direction of the arrow 276. The sleeve 262 is connected to bracket 264 and thereby imparts a force on the link 266. The link 266 is then connected to a steering controller (not shown) for the operation of the watercraft 10.

Although not shown, this embodiment could incorporate locking means as well as stopping means.

Figure 21:
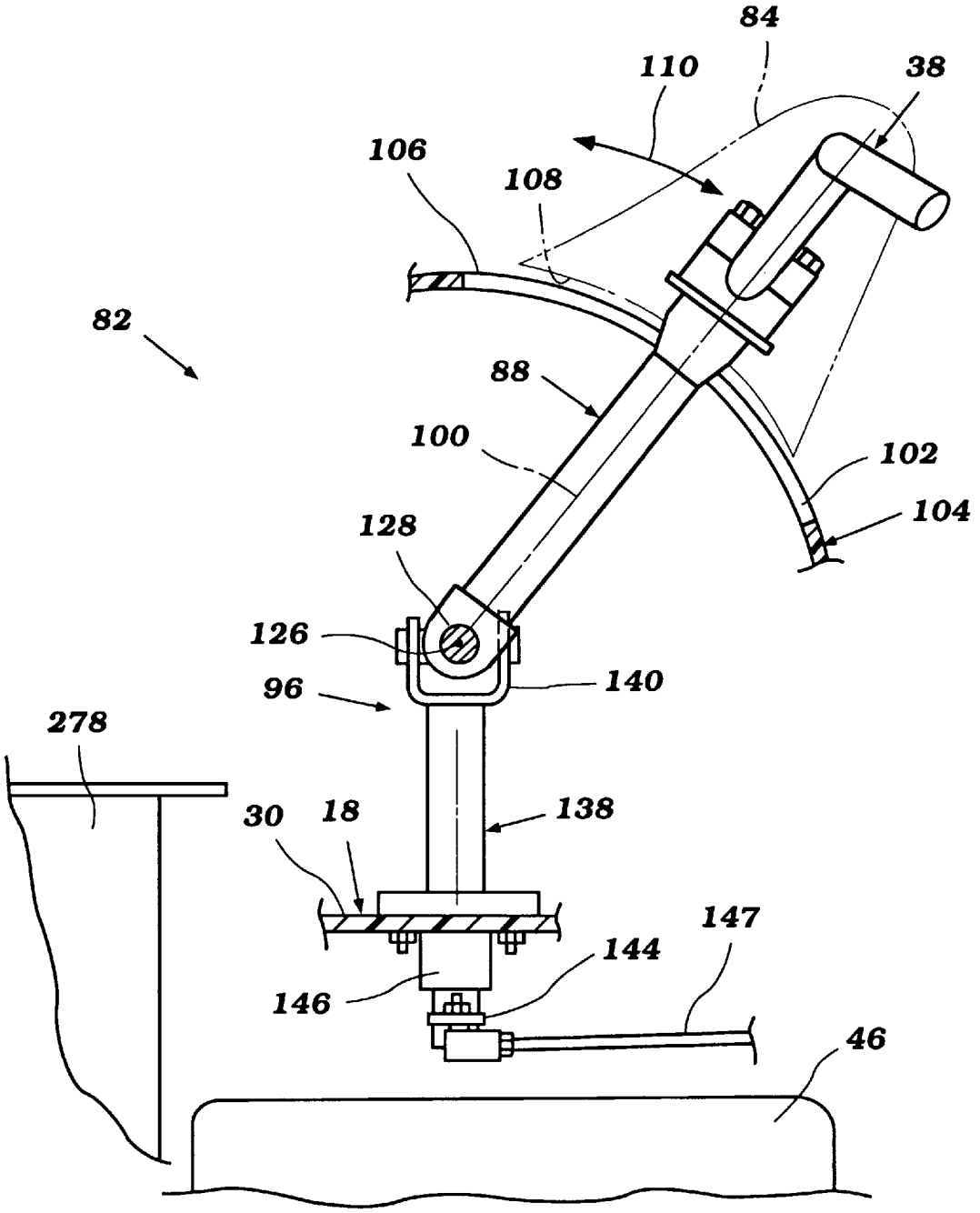
FIG. 21 is a partial side view, with parts shown in cross section and in phantom of still another embodiment of the adjustable steering mechanism of the watercraft of FIG. 1.
Figure 22:
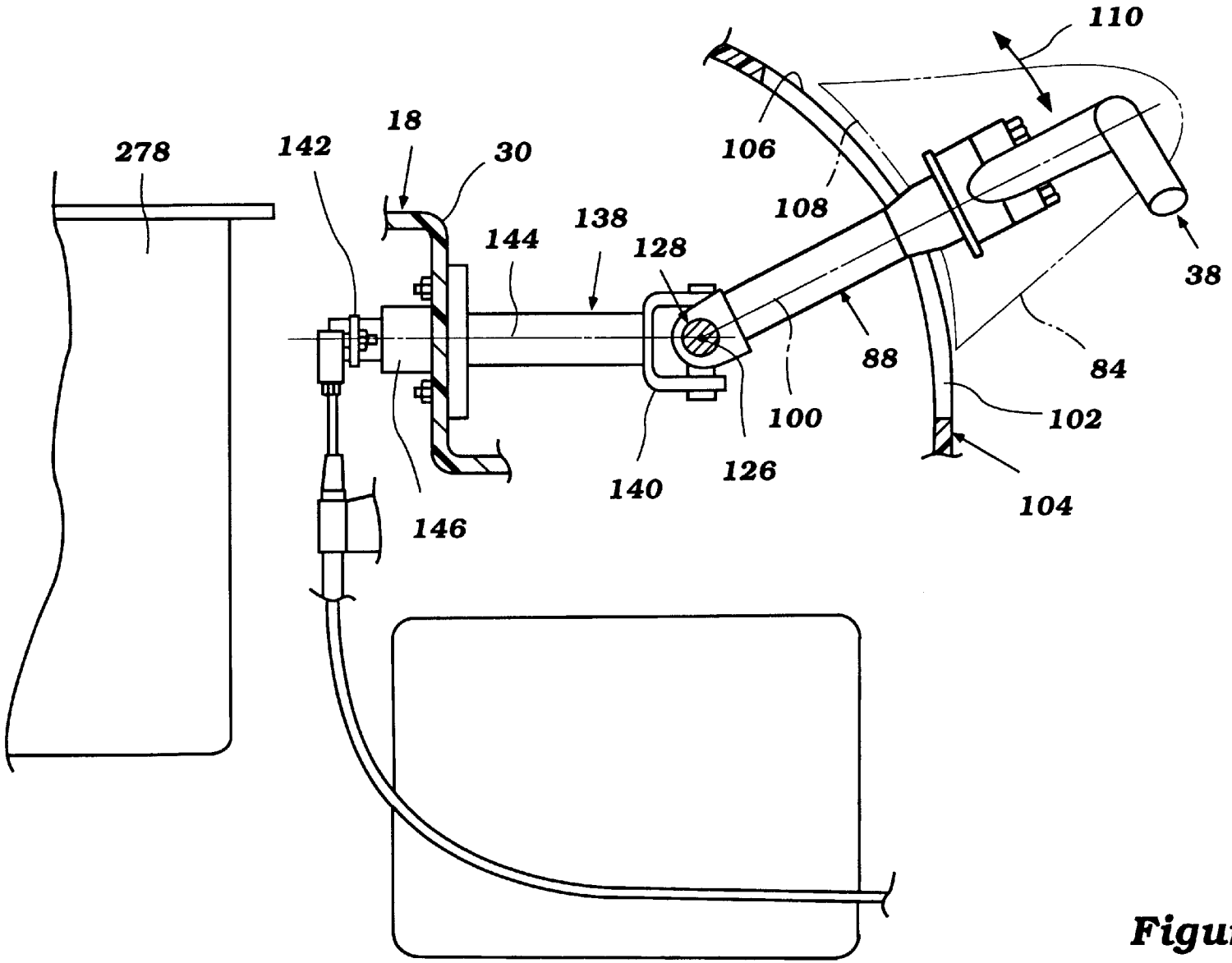
FIG. 22 is a partial side view, with parts shown in cross section and in phantom of yet another embodiment of the adjustable steering mechanism of the watercraft of FIG. 1.

FIGS. 21 and 22 use the same mechanism for rotation as the in the embodiment illustrated in FIGS. 3 through 9. As before, the reference numbers of the common parts will remain the same. By locating the rotation member (not shown in this figure) on top of the wall 30 the designer has greater variety in locating a through hole for the first steering means. For instance, the first steering means 138 extends substantially horizontally in FIG. 22 and substantially vertically in FIG. 21. The bearing means for supporting the first steering means 138 can be located on a top side of the upper wall 30. In this arrangement a support bracket (not shown) for the bearing means 146 would be located in the engine compartment 54 and attached to the bottom side of the upper wall 30.

Also, in FIG. 21 the first steering means 138 extends through the wall 30 at a location substantially near the fuel tank 46. In FIG. 22, however the through hole in the upper wall 30 is substantially near the storage 278.

Although this invention has been described in terms of a certain preferred embodiment, other embodiments apparent to those of ordinary skill in the art are also within the scope of this invention. Accordingly, the scope of the invention is intended to be defined only by the claims that follow.

Of course, the foregoing description is that of preferred embodiments of the invention, and various changes and modifications may be made without departing from the spirit and scope of the invention, as defined by the appended claims.

What is claimed is:

1. A watercraft having a hull including a main body that defines a longitudinal axis, an upper wall cooperating with the main body to define an inner space, an engine disposed within the hull and having an output shaft arranged to drive a water propulsion device of said watercraft, said upper wall having a top surface and a bottom surface, said bottom surface facing forwardly, a steering arrangement extending through said upper wall and coupled with a steering mechanism of said watercraft, said steering arrangement also coupled to a steering shaft and handle, said steering shaft and handle journalled for rotation about a first axis with respect to a rotation member, said rotation member being pivotally affixed to said upper wall thereby allowing the pivoting of said rotation member and said steering shaft and handle in a forward and rearward direction about a second axis that lies generally perpendicular to the longitudinal axis of said watercraft and said first axis, said steering shaft and handle being independently rotatable with respect to said rotation member about said first axis, said steering arrangement further including one or more stoppers in communication with the steering arrangement for limiting the travel of said rotation member in a forward and rearward direction.

2. A watercraft of claim 1 further including a cover member attached to said upper wall at least partially enclosing and encasing at least a portion of said rotation member.

3. A watercraft of claim 1 further including a display panel affixed to said top side of said upper wall wherein said display having a face with an upper edge and a lower edge.

4. A watercraft of claim 1 further including a pad assembly affixed to rotate and pivot with said steering shaft and handle in a forward and rearward direction.

5. A watercraft of claim 4 further comprising a plane substantially perpendicular to said face and extending through said lower edge wherein at a forward rotation of said rotation member said front end of said pad assembly is positioned rearwardly of said plane.

6. A watercraft of claim 4 wherein at a forward rotation of said rotation member said front end of said pad assembly is positioned forwardly of said plane.

7. A watercraft of claim 4 wherein said steering shaft and handle and pad assembly further includes a throttle lever rotating about a third axis substantially vertical during at least a portion of the rotation of said rotation member.

8. A watercraft of claim 7 wherein said third axis is substantially vertical when said steering shaft and handle are rotated in a rearward direction.

9. A watercraft of claim 1 further including a switch box attached to said steering shaft and handle, said switch box including a rearward face.

10. A watercraft of claim 9 wherein when said steering shaft and handle is rotated in a rearward direction said rearward face is substantially vertical.

11. A watercraft of claim 9 wherein when said rearward face is substantially vertical during at least a portion of the rotation of said rotation member.

12. A watercraft of claim 1 further including a universal joint coupling said steering arrangement to said steering shaft and handle, said universal joint being positioned above said top side of said upper wall.

13. A watercraft of claim 12 further including a cover member attached to said top side of said upper wall at least partially enclosing at least a portion of said rotation member and said universal joint.

14. A watercraft of claim 13 wherein said cover includes a longitudinally extending slot and said steering shaft and handle extend through said slot allowing forward and rearward rotation of said steering shaft and handle.

15. A watercraft of claim 14 further including a pad affixed to rotate and pivot with said steering shaft and handle.

16. A watercraft of claim 15 wherein said pad includes a generally arcuate bottom side a front edge and a rear edge.

17. A watercraft of claim 16 wherein at least a portion of said pad is positioned above said cover.

18. A watercraft of claim 13 wherein said cover further includes a generally arcuate top side.

19. A watercraft of claim 18 wherein said steering shaft and handle is rotatable about said universal joint and said front edge of said pad is positioned forward of said universal joint when said steering shaft and said handle and said pad are rotated in a forward direction.

20. A watercraft of claim 1 further including at least one bearing affixed to the top side of said upper wall for rotatably supporting said steering arrangement.

21. A watercraft of claim 20 further including a support bracket for reinforcing said at least one bearing, said support bracket being located on a bottom side of said upper wall.

22. A watercraft of claim 21 further including a releasable lock.

23. A watercraft of claim 22 further including a cover member attached to said top side of said upper wall at least partially enclosing said at least one bearing and said releasable lock.

24. The watercraft of claim 1, further comprising a releasable lock for securing said rotation member at an angle of rotation selected by the operator of said watercraft.

25. The watercraft of claim 24 wherein said releasable lock permits said rotation member to be secured at predetermined positions.

26. The watercraft of claim 24 wherein said releasable lock is located between said top surface of said upper wall and said steering shaft.

27. The watercraft of claim 1, further comprising a spring affixed to said fixed portion and said rotating portion.

28. The watercraft of claim 22 wherein said spring counterbalances said rotation member and said steering shaft and handle.

29. The watercraft of claim 1, further including a universal joint coupling said steering mechanism to said steering shaft and handle, at least a portion of said universal joint being positioned above said top side of said upper wall.

30. The watercraft of claim 1 further including one or more bearings affixed to the top side of said upper wall for rotatably supporting said steering arrangement.

31. A watercraft having a hull including a main body that defines a longitudinal axis, an upper wall cooperating with the main body to define an inner space, an engine disposed within the hull and having an output shaft arranged to drive a water propulsion device of said watercraft, said upper wall having a top surface and a bottom surface, said bottom surface facing forwardly, a steering arrangement extending through said upper wall and coupled with a steering mechanism of said watercraft, said steering arrangement also coupled to a steering shaft and handle, said steering shaft and handle journalled for rotation about a first axis with respect to a rotation member, said rotation member being pivotally affixed to said upper wall thereby allowing the pivoting of said rotation member and said steering shaft and handle in a forward and rearward direction about a second axis that lies generally perpendicular to the longitudinal axis of said watercraft and said first axis, said steering shaft and handle being independently rotatable with respect to said rotation member about said first axis, said rotation member including at least one fixed portion pivotally coupled with at least one rotating portion, said steering shaft and handle being rotatably affixed to said rotation portion, said steering arrangement further including at least one spring affixed to said fixed portion and said rotating portion.

32. The watercraft of claim 31, further comprising a releasable lock for securing said rotation member at an angle of rotation selected by the operator of said watercraft.

33. The watercraft of claim 32 wherein said releasable lock permits said rotation member to be secured at predetermined positions.

34. The watercraft of claim 32 wherein said releasable lock is located between said top surface of said upper wall and said steering shaft.

35. The watercraft of claim 31, further comprising a spring affixed to said fixed portion and said rotating portion.

36. The watercraft of claim 31 wherein said spring counterbalances said rotation member and said steering shaft and handle.

37. The watercraft of claim 31, further including a pad assembly affixed to rotate and pivot with said steering shaft and handle.

38. The watercraft of claim 37, wherein said pad assembly is affixed to rotate and pivot with said steering shaft and handle in a forward and rearward direction.

39. The watercraft of claim 31, further including a display panel affixed to said top side of said upper wall on a side opposite said engine compartment.

40. The watercraft of claim 31, further including a universal joint coupling said steering mechanism to said steering shaft and handle, at least a portion of said universal joint being positioned above said top side of said upper wall.

41. The watercraft of claim 31 further including one or more bearings affixed to the top side of said upper wall for rotatably supporting said steering arrangement.

42. A watercraft having a hull including a main body that defines a longitudinal axis, an upper wall cooperating with the main body to define an inner space, an engine disposed within the hull and having an output shaft arranged to drive a water propulsion device of said watercraft, said upper wall having a top surface and a bottom surface, said bottom surface facing forwardly, a steering arrangement extending through said upper wall and coupled with a steering mechanism of said watercraft, said steering arrangement also coupled to a steering shaft and handle, said steering shaft and handle journalled for rotation about a first axis with respect to a rotation member, said rotation member being pivotally affixed to said upper wall thereby allowing the pivoting of said rotation member and said steering shaft and handle in a forward and rearward direction about a second axis that lies generally perpendicular to the longitudinal axis of said watercraft and said first axis, said steering shaft and handle being independently rotatable with respect to said rotation member about said first axis, said steering arrangement further including a sealing member adjacent to said upper wall to seal said steering arrangement extending through said upper wall.

43. A watercraft of claim 42 wherein said steering shaft is coupled to said rotation member by at least two bearings.

44. A watercraft of claim 43 wherein said steering arrangement is coupled to said steering shaft at a position on said steering shaft between at least two bearings.

45. A watercraft of claim 44 wherein said steering arrangement extends substantially horizontally.

46. A watercraft of claim 44 wherein said steering arrangement extends substantially vertically.

47. The watercraft of claim 42, further comprising a releasable lock for securing said rotation member at an angle of rotation selected by the operator of said watercraft.

48. The watercraft of claim 47 wherein said releasable lock permits said rotation member to be secured at predetermined positions.

49. The watercraft of claim 47 wherein said releasable lock is located between said top surface of said upper wall and said steering shaft.

50. The watercraft of claim 42, further comprising a spring affixed to said fixed portion and said rotating portion.

51. The watercraft of claim 42 wherein said spring counterbalances said rotation member and said steering shaft and handle.

52. The watercraft of claim 42, further including a pad assembly affixed to rotate and pivot with said steering shaft and handle.

53. The watercraft of claim 52, wherein said pad assembly is affixed to rotate and pivot with said steering shaft and handle in a forward and rearward direction.

54. The watercraft of claim 42, further including a display panel affixed to said top side of said upper wall on a side opposite said engine compartment.

55. The watercraft of claim 42, further including a universal joint coupling said steering mechanism to said steering shaft and handle, at least a portion of said universal joint being positioned above said top side of said upper wall.

56. The watercraft of claim 42 further including one or more bearings affixed to the top side of said upper wall for rotatably supporting said steering arrangement.

57. A watercraft having a hull including a main body that defines a longitudinal axis, an upper wall cooperating with the main body to define an inner space, an engine disposed within the hull and having an output shaft arranged to drive a water propulsion device of said watercraft, a seat located on a side of said upper wall opposite said engine compartment, a first steering arrangement extending through said upper wall and in communication with a steering mechanism on said watercraft, said first steering arrangement also coupled to a second steering arrangement, said second steering arrangement rotatably affixed to a rotation member, said rotation member being affixed to a side of said upper wall opposite said engine compartment thereby allowing the rotation of said rotation member and said second steering arrangement about an axis generally perpendicular to a longitudinal axis of said watercraft and locking means for releasably locking the rotation member, and further including rotation limiting means for limiting the travel of said rotation member in a forward and rearward direction.

58. A watercraft of claim 52 wherein said rotation member includes at least one fixed portion pivotally coupled with at least one rotating portion and said second steering arrangement is rotatably affixed to said rotation portion.

59. A watercraft of claim 58 further a spring affixed to said fixed portion and said rotating portion for counterbalancing said rotation member and said second steering arrangement.

60. A watercraft of claim 59 further including a cover member attached to said upper wall at least partially enclosing and encasing at least a portion of said rotation member.

61. A watercraft claim 57 further including a gauge panel affixed to said upper top side of said wall on a side opposite said engine compartment.

62. A watercraft of claim 57 further including a pad and handle bar assembly connected to said second steering arrangement, said pad and handle bar assembly being affixed to rotate and pivot with said second steering arrangement.

63. A watercraft of claim 62 wherein at a forward rotation of said rotation member said pad and handle bar assembly at least partially cover said gauge panel.

64. A watercraft of claim 62 wherein said pad and handle bar assembly further includes a throttle lever rotating about at axis substantially vertical during at least part of the rotation of said rotation member.

* * * * *